US009091485B2

(12) United States Patent
Bugler, III et al.

(10) Patent No.: US 9,091,485 B2
(45) Date of Patent: Jul. 28, 2015

(54) HYBRID HEAT EXCHANGER APPARATUS AND METHOD OF OPERATING THE SAME

(75) Inventors: Thomas W. Bugler, III, Frederick, MD (US); Davey J. Vadder, Westminster, MD (US)

(73) Assignee: EVAPCO, INC., Westminster, MD (US)

( * ) Notice: Subject to any disclaimer, the term of this patent is extended or adjusted under 35 U.S.C. 154(b) by 539 days.

(21) Appl. No.: 12/906,674

(22) Filed: Oct. 18, 2010

(65) Prior Publication Data

US 2012/0061055 A1 Mar. 15, 2012

Related U.S. Application Data

(63) Continuation of application No. 12/882,614, filed on Sep. 15, 2010, now abandoned.

(51) Int. Cl.

| | |
|---|---|
| ***F28F 27/02*** | (2006.01) |
| ***F28B 1/00*** | (2006.01) |
| ***F24F 3/14*** | (2006.01) |

(Continued)

(52) U.S. Cl.

CPC . *F28C 1/14* (2013.01); *F28F 25/06* (2013.01); *F28F 27/003* (2013.01); *F28C 2001/145* (2013.01)

(58) Field of Classification Search

CPC ..... F28C 1/00; F28C 1/14; F28C 1/16; F28C 1/02; F28C 2001/145; F28F 27/003; F28F 27/02; F28F 25/02; F28F 25/06; F28D 15/00

USPC ..... 165/48.1, 60, 101, 103, 110, 117, 122, 165/132, 175, 222, 226, 228, 900; 62/310, 62/413; 261/112, 152, 153, 155, 159, 305

See application file for complete search history.

(56) References Cited

U.S. PATENT DOCUMENTS

| | | | |
|---|---|---|---|
| 2,890,864 | A | 6/1959 | Stutz |
| 3,148,516 | A | 9/1964 | Kals |

(Continued)

FOREIGN PATENT DOCUMENTS

| | | | |
|---|---|---|---|
| CN | 1215830 | A | 5/1999 |
| CN | 1266174 | A | 9/2000 |
| WO | WO-2012/036781 | A2 | 3/2012 |

OTHER PUBLICATIONS

International Search Report and the The Written Opinion of the International Searching Authority, or the Declaration issued Jan. 6, 2012 for International Application No. PCT/US2011/045945.

(Continued)

*Primary Examiner* — Travis Ruby

(74) *Attorney, Agent, or Firm* — Fishman Stewart Yamaguchi PLLC

(57) ABSTRACT

A hybrid heat exchanger apparatus includes a direct heat exchanger device and an indirect heat exchanger device and a method of operating the same encompasses conveying a hot fluid to be cooled from a hot fluid source through the indirect heat exchanger device to a cooling fluid distribution system. The hot fluid to be cooled is distributed from the cooling fluid distribution system onto the direct heat exchanger device. In a hybrid wet/dry mode, ambient air flows across both the indirect heat exchanger device and the direct heat exchanger device to generate hot humid air from the ambient air flowing across the direct heat exchanger device and hot dry air from the ambient air flowing across the indirect heat exchanger device.

37 Claims, 13 Drawing Sheets

(51) Int. Cl.

| | |
|---|---|
| ***F28C 1/14*** | (2006.01) |
| ***F28F 25/06*** | (2006.01) |
| ***F28F 27/00*** | (2006.01) |

(56) References Cited

U.S. PATENT DOCUMENTS

| | | | | |
|---|---|---|---|---|
| 3,831,667 | A | 8/1974 | Kilgore et al. | |
| 3,865,911 | A * | 2/1975 | Lefevre | 261/140.1 |
| 3,903,213 | A | 9/1975 | Stover | |
| 4,252,752 | A | 2/1981 | Flandroy | |
| 4,337,216 | A * | 6/1982 | Korsell | 261/112.2 |
| 4,448,211 | A | 5/1984 | Yoshida | |
| 4,893,669 | A | 1/1990 | Kashiwada et al. | |
| 5,724,828 | A | 3/1998 | Korenic | |
| 5,816,318 | A | 10/1998 | Carter | |
| 6,142,219 | A | 11/2000 | Korenic et al. | |
| 6,213,200 | B1 | 4/2001 | Carter et al. | |
| 6,564,864 | B2 | 5/2003 | Carter et al. | |

OTHER PUBLICATIONS

PCT/US2011/043552 Notification of Transmittal of the International Search Report and the Written Opinion of the International Searching Authority, or Declaration issued Dec. 5, 2011. Forms PCT/ISA/220—PCT/ISA/210—PCT/ISA/237.

Chinese Office Action issued Dec. 3, 2014 for corresponding Chinese Application No. 2011800443998.

Extended European Search Report issued Mar. 4, 2015 for corresponding European Application No. 11825597.5.

* cited by examiner

HYBRID HEAT EXCHANGER APPARATUS AND METHOD OF OPERATING THE SAME

CROSS-REFERENCE TO RELATED APPLICATION

This is a Continuation application of application Ser. No. 12/882,614, filed on Sep. 15, 2010, the entirety of which is incorporated herein by reference for all purposes.

FIELD OF THE INVENTION

The present invention relates to a hybrid heat exchanger apparatus. More particularly, the present invention is directed to a hybrid heat exchanger apparatus that operates in a wet mode and a hybrid wet/dry mode in order to conserve water and, possibly, abate plume.

BACKGROUND OF THE INVENTION

Heat exchangers are well known in the art. By way of example, a conventional heat exchanger 2 is diagrammatically illustrated in FIG. 1 and is sometimes referred to as a "cooling tower". The heat exchanger 2 includes a container 4, a direct heat exchanger device 6, a conventional cooling fluid distribution system 8, an air flow mechanism such as a fan assembly 10 and a controller 12. The container 4 has a top wall 4*a*, a bottom wall 4*b* and a plurality of side walls 4*c*. The plurality of side walls 4*c* are connected to each other and connected to the top wall 4*a* and the bottom wall 4*b* to form a generally box-shaped chamber 14. The chamber 14 has a water basin chamber portion 14*a*, an exit chamber portion 14*b* and a central chamber portion 14*c*. The water basin portion 14*a* is defined by the bottom wall 4*b* and lower portions of the side walls 4*c*. The water basin portion 14*a* contains cooled fluid as discussed in more detail below. The exit chamber portion 14*b* is defined by the top wall 4*a* and upper portions of the side walls 4*c*. The central chamber portion 14*c* is defined between and among central portions of the connected side walls 4*c* and is positioned between the water basin chamber portion 14*a* and the exit chamber portion 14*b*. The top wall 4*a* is formed with an air outlet 16. The air outlet 16 is in fluid communication with the exit chamber portion 14*b*. Also, for this particular conventional heat exchanger 2, each one of the side walls 4*c* is formed with an air inlet 18 in communication with the central chamber portion 14*c*. A plurality of louver modules 20 are mounted to the side walls 4*c* in the respective air inlets 18. The plurality of louver modules 20 are disposed adjacent to and above the water basin chamber portion 14*a* and are operative to permit ambient air, illustrated as Cold Air IN arrows, to enter into the central chamber portion 14*c*.

The direct heat exchanger device 6 is disposed in and extends across the central chamber portion 14*c* adjacent to and below the exit chamber portion 14*b*. The direct heat exchanger device 6 is operative to convey a hot fluid, illustrated as a Hot Fluid IN arrow, therethrough from a hot fluid source 22. It would be appreciated by a skilled artisan that the hot fluid is typically water but it might be some other liquid fluid. The hot fluid exits the direct heat exchanger device 6 as cooled fluid, illustrated as a Cooled Fluid OUT arrow. Although the direct heat exchanger device 6 is diagrammatically illustrated as a film fill material structure, a skilled artisan would comprehend that the direct heat exchanger device 6 can be any other conventional direct heat exchanger device such as a splash bar or splash deck structure.

The cooling fluid distribution system 8 includes a fluid distribution manifold 24 that extends across the central chamber portion 14*c* and is disposed above and adjacent to the direct heat exchanger device 6. In a Pump ON state, a pump 26 is operative for pumping the hot fluid illustrated as a Hot Fluid IN arrow from the hot fluid source 22 to and through the fluid distribution manifold 24. Thus, the hot fluid illustrated as a Hot Fluid IN arrow is distributed onto the direct heat exchanger device 6 as represented by the water droplets 28 in FIG. 1. When the water droplets 28 rain downwardly onto the direct heat exchanger device 6 and into the water basin chamber portion 14*a*, the conventional heat exchanger 2 is considered to be in a WET mode. The water droplets 28 accumulate in the water basin chamber portion 14*a* as the cooled fluid, which is usually pumped back to the hot fluid source 22 represented by the Cooled Fluid OUT arrow.

As illustrated in FIG. 1, the cooling fluid distribution system 8 includes a plurality of spray nozzles 30. The spray nozzles 30 are connected to and are in fluid communication with the fluid distribution manifold 24 so that the pump 26 pumps the hot fluid from the hot fluid source 22, to the fluid distribution manifold 24 and through the spray nozzles 30. However, one of ordinary skill in the art would appreciate that in lieu of the cooling fluid distribution system 8 that includes spray nozzles 30, the cooling fluid distribution system 8 might include a weir arrangement, a drip arrangement or some other conventional fluid distribution arrangement with or without spray nozzles.

Furthermore, in FIG. 1, the heat exchanger 2 includes an eliminator structure 32 that extends across the chamber 14 and is disposed between the fluid distribution manifold 24 and the air outlet 16. The eliminator structure 32 is positioned in a manner such that the exit chamber portion 14*b* of the chamber 14 is disposed above the eliminator structure 32 and the central chamber portion 14*c* of the chamber 14 is disposed below the eliminator structure 32.

In a Fan ON state shown in FIG. 1, the fan assembly 10 is operative for causing the ambient air represented by the Cold Air IN arrows to flow through the heat exchanger 2 from the air inlet 18, across the direct heat exchanger device 6 and the fluid distribution manifold 24 and through the air outlet 16. As shown in FIG. 1, in the WET mode, hot humid air represented by Hot Humid Air Out arrow flows out of the air outlet 16. As known in the art, the fan assembly 10 shown in FIGS. 1 and 2 is an induced draft system to induce the ambient air to flow through the container 4 as illustrated.

The controller 12 is operative to selectively energize or de-energize the cooling fluid distribution system 8 and the fan assembly 10 by automatically or manually switching the cooling fluid distribution system 8 and the fan assembly 10 between their respective ON states and an OFF states in order to cause the heat exchanger 2 to operate in either the WET mode or an OFF mode (not illustrated). The controller 12 might be an electro-mechanical device, a software-operated electronic device or even a human operator. For the heat exchanger 2 to be in the OFF mode, i.e., in an inoperative mode, the controller 12 switches the fan assembly 10 to the Fan OFF state and switches the pump 26 to the Pump OFF state. In FIG. 1, for the heat exchanger 2 to be in the WET mode, the controller 12 switches the fan assembly 10 to the Fan ON state and switches the pump 26 to the Pump ON state. More particularly, in the WET mode, both the fan assembly 10 and the cooling fluid distribution system 8 are energized resulting in the ambient air (Cold Air IN arrows) flowing through the direct heat exchanger device 6 and the hot fluid being distributed onto and across the direct heat exchanger device 6 to generate the hot humid air (Hot Humid Air OUT arrow in FIG. 1) that exits through the air outlet 16.

Throughout the year, the heat exchanger 2 operates in the WET mode. Sometimes, during the spring, fall and winter months, the ambient conditions cause the hot humid air that exits the heat exchanger to condense, thereby forming a visible plume P of water condensate. Occasionally, the general public mistakenly perceives this visible plume P of water condensate as polluting smoke. Also, some people, who know that this plume P is merely water condensate, believe that the minute water droplets that constitute the visible plume P might contain disease-causing bacteria. As a result, a heat exchanger that spews a visible plume P of water condensate is undesirable.

There are two limitations on heat exchangers that the present invention addresses. First, particularly in cold climates, cooling towers can emit plume when the warm, humid air being discharged from the unit meets the cold, dry air in the ambient environment. The general public sometimes mistakenly perceives this visible plume of water condensate as air-polluting smoke. Second, water is considered to be a scarce and valuable resource in certain regions. In certain aspects of the present invention, there is an increased capacity to perform the cooling functions in a DRY mode, where little or no water is needed to achieve the cooling function.

A skilled artisan would appreciate that the diagrammatical views provided herein are representative drawing figures that represent either a single heat exchanger as described herein or a bank of heat exchangers.

It would be beneficial to provide a heat exchanger that conserves water. It would also be beneficial to provide a heat exchanger apparatus that might also inhibit the formation of a plume of water condensate. The present invention provides these benefits.

OBJECTS AND SUMMARY OF THE INVENTION

It is an object of the invention to provide a hybrid heat exchanger apparatus that might inhibit the formation of a plume of water condensate when ambient conditions are optimal for formation of the same.

It is another object of the invention to provide a hybrid heat exchanger apparatus that conserves water by enhanced dry cooling capabilities.

Accordingly, a hybrid heat exchanger apparatus of the present invention is hereinafter described. The hybrid heat exchanger apparatus of the present invention is adapted for cooling a hot fluid flowing from a hot fluid source and includes an indirect heat exchanger device, a cooling fluid distribution system and a direct heat exchanger device. The hybrid heat exchanger apparatus of the present invention also includes a device such as the pump for conveying the hot fluid to be cooled from the hot fluid source through the indirect heat exchanger device to the cooling fluid distribution system for distributing the hot fluid to be cooled from the cooling fluid distribution system onto the direct heat exchanger device. The hybrid heat exchanger apparatus of the present invention further includes an air flow mechanism such as a fan assembly for causing the ambient air to flow across both the indirect heat exchanger device and the direct heat exchanger device in order to generate hot humid air from the ambient air flowing across the direct heat exchanger device and hot dry air from the ambient air flowing across the indirect heat exchanger device. One aspect of the present invention mixes the hot humid air and the hot dry air together to form a hot mixture thereof to abate plume if the appropriate ambient conditions are present. Another aspect of the present invention isolates the hot humid air and the hot dry air from one another and, therefore, does not necessarily abate plume but it does conserve water.

A method inhibits formation of a water-based condensate from the heat exchanger apparatus that is operative for cooling a hot fluid to be cooled flowing from a hot fluid source. The heat exchanger apparatus has an indirect heat exchanger device, a cooling fluid distribution system and a direct heat exchanger device. The method includes the steps of:

conveying the hot fluid to be cooled from the hot fluid source through the indirect heat exchanger device to the cooling fluid distribution system;

distributing the hot fluid to be cooled from the cooling fluid distribution system onto the direct heat exchanger device; and causing ambient air to flow across both the indirect heat exchanger device and the direct heat exchanger device to generate hot humid air from the ambient air flowing across the direct heat exchanger device and hot dry air from the ambient air flowing across the indirect heat exchanger device.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1:
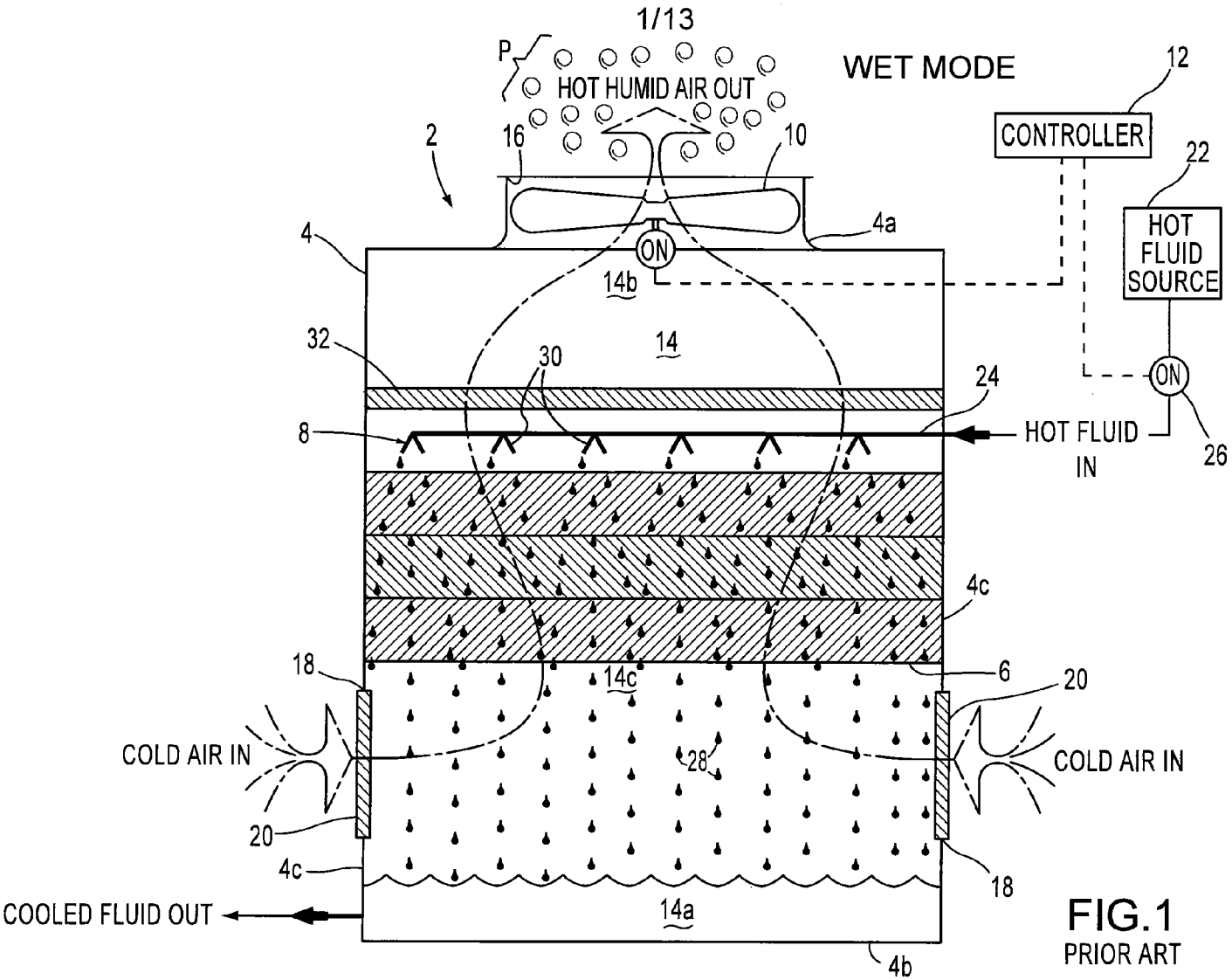
FIG. 1 PRIOR ART
FIG. 1 is a schematic diagram of a conventional heat exchanger operating in a wet mode.

Hereinafter, exemplary embodiments of the present invention will be described with reference to the attached drawing figures. The structural components common to those of the prior art and the structural components common to respective embodiments of the present invention will be represented by the same symbols and repeated description thereof will be omitted. Furthermore, terms such as "cooled", "hot", "humid", "dry" and the like shall be construed as relative terms only as would be appreciated by a skilled artisan and shall not be construed in any limiting manner whatsoever.

A first exemplary embodiment of a hybrid heat exchanger apparatus 100 of the present invention is hereinafter described with reference to FIGS. 2 and 3. The hybrid heat exchanger apparatus 100 is adapted for cooling the hot fluid, i.e. the hot fluid to be cooled and illustrated as the Hot Fluid IN arrow, from the hot fluid source 22. The hybrid heat exchanger apparatus 100 includes the container 4, a direct heat exchanger device 106*a*, an indirect heat exchanger device 106*b*, a cooling fluid distribution system 108, the pump 26, the fan assembly 10 and a controller 112. The direct heat exchanger device 106*a* is disposed in and extends partially across the central chamber portion 14*c* adjacent to and below the exit chamber portion 14*b*. The direct heat exchanger device 106*a* is operative to convey the hot fluid to be cooled (illustrated as a Hot Fluid IN arrow) therethrough from cooling fluid distribution system 108.

Figure 2:
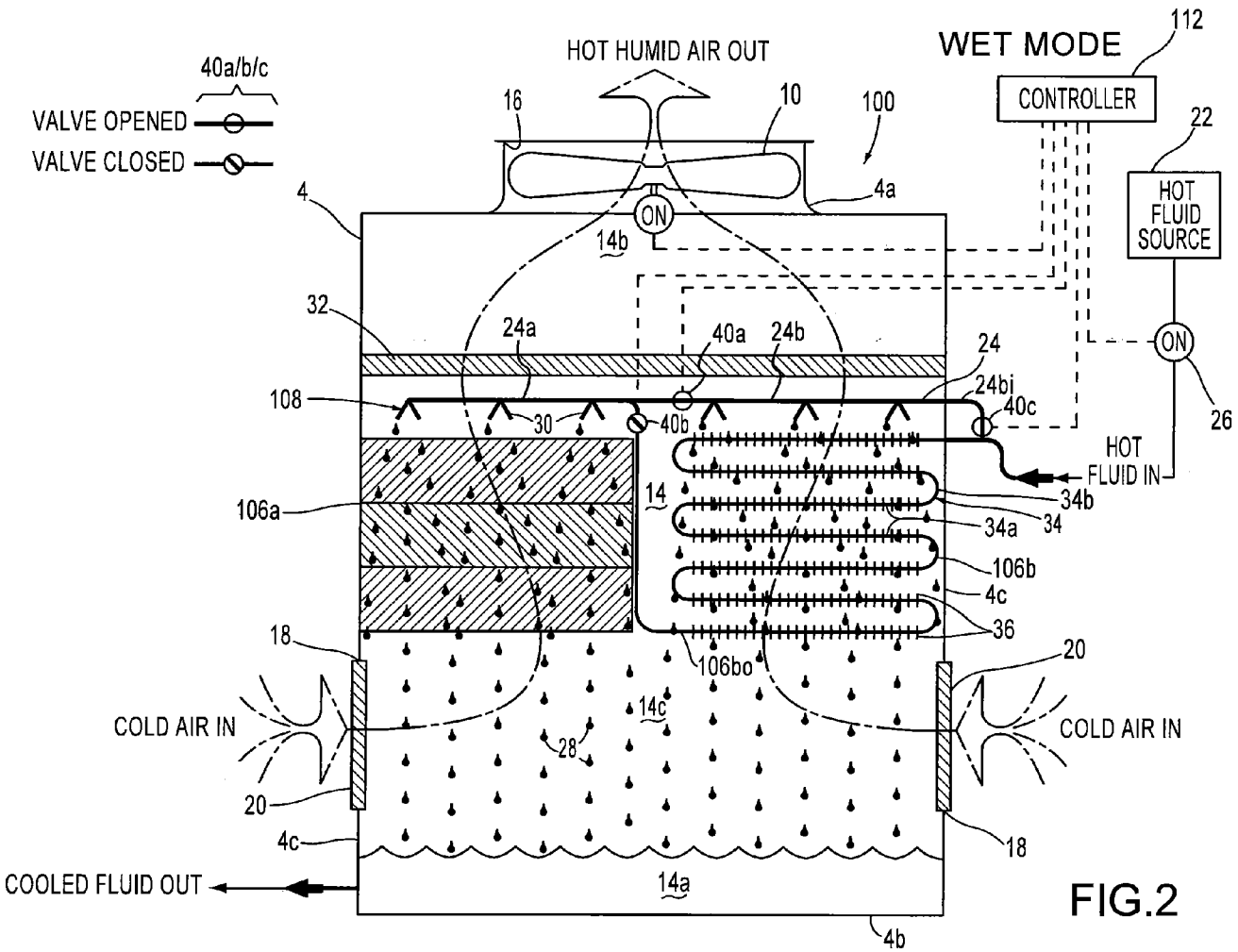
FIG. 2 is a schematic diagram of a first exemplary embodiment of the hybrid heat exchanger apparatus of the present invention operating in the wet mode.
Figure 3:
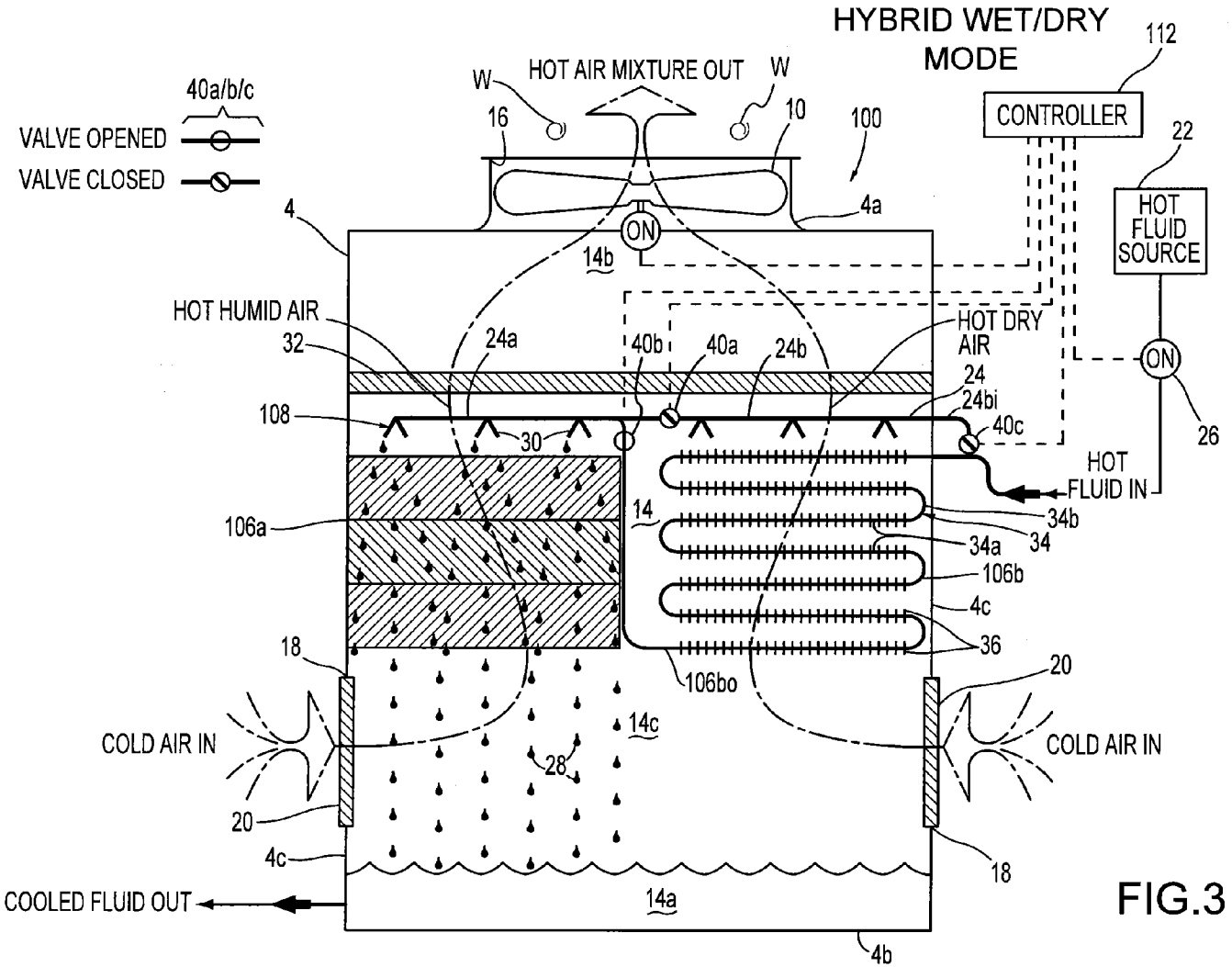
FIG. 3 is a schematic diagram of the first exemplary embodiment of the hybrid heat exchanger apparatus of the present invention operating in a hybrid wet/dry mode.

As shown in FIGS. 2 and 3, the indirect heat exchanger device 106*b* is disposed in and extends partially across the central chamber portion 14*c* adjacent to and below the exit chamber portion 14*b*. The indirect heat exchanger device 106*b* is operative to be in selective fluid communication with the direct heat exchanger device 106*a* as discussed in more detail below. The indirect heat exchanger device 106*b* and the direct heat exchanger device 106*a* are juxtaposed one another.

As depicted in FIGS. 2 and 3, the cooling fluid distribution system 108 includes the fluid distribution manifold 24 that extends across the central chamber portion 14*c*. The fluid distribution manifold 24 has a first fluid distribution manifold section 24*a* that is disposed above and adjacent to the direct heat exchanger device 106*a* and a second fluid distribution manifold section 24*b* that is in selective fluid communication with the first fluid distribution manifold section 24*a*. The second fluid distribution manifold section 24*b* is disposed above and adjacent to the indirect heat exchanger device 106*b*. The pump 26 operative in the Pump ON state for pumping the hot fluid (illustrated as a Hot Fluid IN arrow) to be cooled from the hot fluid source 22 to the first fluid distribution manifold section 24*a* via the indirect heat exchanger device 106*b* or to the first fluid distribution manifold section 24*a* via the second fluid distribution manifold section 24*b*. The fan assembly 10 is operative for causing ambient air illustrated as the Cold Air IN arrows to flow through the hybrid heat exchanger apparatus 100 from the air inlet 18, across the indirect heat exchanger device 106*b*, the direct heat exchanger device 106*a* and the fluid distribution manifold 24 and through the air outlet 16. The controller 112 is operative for causing the hybrid heat exchanger apparatus 100 to operate in either a WET mode or a Hybrid WET/DRY mode.

In the WET mode shown in FIG. 2, the fan assembly 10 and the pump 26 are energized in their respective ON states while the indirect heat exchanger 106*b* and the direct heat exchanger 106*a* are in fluid isolation from one another and the first fluid distribution manifold section 24*a* and the second fluid distribution manifold section 24*b* are in fluid communication with each other. As a result, the ambient air illustrated as the Cold Air IN arrows flows across the indirect heat exchanger device 106*b* and the direct heat exchanger device 106*a* so that the hot fluid to be cooled (illustrated as a Hot Fluid IN arrow) is distributed to wet the direct heat exchanger device 106*a* from the first fluid distribution manifold section 24*a* and to wet the indirect heat exchanger device 106*b* from the second fluid distribution manifold section 24*b* in order to generate HOT HUMID AIR that subsequently exits through the air outlet 16. In the WET mode for first exemplary embodiment of the hybrid heat exchanger apparatus 100 of the present invention, the indirect heat exchanger 106*b* operates in a direct heat exchange state.

In the HYBRID WET/DRY mode shown in FIG. 3, both the fan assembly 10 and the pump 26 are energized in their respective ON states while the indirect heat exchanger device 106*b* and the first fluid distribution manifold section 24*a* are in fluid communication and the first fluid distribution manifold section 24*a* and the second fluid distribution manifold section 24*b* are in fluid isolation from one another. As a result, the ambient air (illustrated as the Cold Air IN arrows) flows across the indirect heat exchanger device 106*b* and the direct heat exchanger device 106*a* so that the hot fluid to be cooled (illustrated as a Hot Fluid IN arrow) is distributed to wet the direct heat exchanger device 106*a* from the first fluid distribution manifold section 24*a* in order to generate HOT HUMID AIR (See FIG. 3) while allowing the indirect heat exchanger device 106*b* to be dry in order to generate HOT DRY AIR (See FIG. 3) that subsequently mixes with the HOT HUMID AIR to form a HOT AIR MIXTURE represented by the HOT AIR MIXTURE arrow that subsequently exits through the air outlet 18. In the HYBRID WET/DRY mode for first exemplary embodiment of the hybrid heat exchanger apparatus 100 of the present invention, the indirect heat exchanger 106*b* operates in an indirect heat exchange state.

One of ordinary skill in the art would appreciate that mixing of the HOT HUMID AIR and the HOT DRY AIR to form the HOT AIR MIXTURE is achieved as a result of the torrent of air flowing through the container 4 as well as through the fan assembly 10. Additional mixing, if desired, can also be achieved as discussed hereinbelow.

By way of example only and not by way of limitation and for the first exemplary embodiment of the hybrid heat exchanger apparatus 100 of the present invention, the indirect heat exchanger device 106*b* is a single, continuous tube structure which is represented in the drawing figures as a single, continuous tube 34 and the direct heat exchanger device 106*a* is a fill material structure. However, one of ordinary skill in the art would appreciate that, in practice, the tubular structure is actually fabricated from a plurality of tubes aligned in rows. Furthermore, as is known in the art, heat exchangers sometimes use fill media, as a direct means of heat transfer and mentioned above as a fill material structure, whether alone or in conjunction with coils such as the invention described in U.S. Pat. No. 6,598,862. Again, by way of example only, the representative single, continuous tube structure 34 of the indirect heat exchanger device 106*b* has a plurality of straight tube sections 34*a* and a plurality of return bend sections 34*b* interconnecting the straight tube sections 34*a*. Again, by way of example only, each straight tube section 34*a* carries a plurality of fins 36 connected thereto to form a finned tube structure.

In FIGS. 2 and 3, the hybrid heat exchanger apparatus 10 includes the eliminator structure 32. The eliminator structure 32 extends across the chamber 14 and is disposed between the fluid distribution manifold 24 and the air outlet 16. The exit chamber portion 14*b* of the chamber 14 is disposed above the eliminator structure 32 and the central chamber portion 14*c* of the chamber 14 disposed below the eliminator structure 32.

For the first exemplary embodiment of the hybrid heat exchanger apparatus 100 illustrated in FIGS. 2 and 3, the cooling fluid distribution system 108 includes a first valve 40*a*, a second valve 40*b* and a third valve 40*c*. The first valve 40*a* is interposed between the first fluid distribution manifold section 24*a* and the second fluid distribution manifold section 24*b*. The second valve 40*b* is disposed downstream of an indirect heat exchanger device outlet 106*bo* of the indirect heat exchanger device 106*b* and between the first fluid distribution manifold section 24*a* and the second fluid distribution manifold section 24*b*. The third valve 40*c* is disposed downstream of the pump 26 and upstream of a second fluid distribution manifold section inlet 24*bi* of the second fluid distribution manifold section 24*b*. In the WET mode shown in FIG. 2, the first valve 40*a* is in an opened state to fluidically connect the first and second fluid distribution manifold sections 24*a* and 24*b* respectively, the second valve 40*b* is in a closed state to fluidically isolate the first fluid distribution manifold section 24*a* and the indirect heat exchanger device 106*b* and the third valve 40*c* is in the opened state to fluidically connect the hot fluid source 22 and the second fluid distribution manifold section 24*b*. In the HYBRID WET/DRY mode in FIG. 3, the first valve 40*a* is in a closed state to fluidically isolate the first and second fluid distribution manifold sections 24*a* and 24*b* respectively, the second valve 40*b* is in an opened state to fluidically connect the first fluid distribution manifold section 24*a* and the indirect heat exchanger device 106*b* and the third valve 40*c* is in the closed state to fluidically isolate the second fluid distribution manifold section 24*b* and the hot fluid source 22.

The controller 112 is operative to energize or de-energize the pump 26 and/or the fan assembly 10 by automatically or manually switching the pump 26 and the fan assembly 10 between their respective ON states and an OFF states as is known in the art. For the first exemplary embodiment of the hybrid heat exchanger apparatus 100, the controller 112 is also operative to move the first valve 40*a*, the second valve 40*b* and the third valve 40*c* to and between their respective opened and closed states as illustrated by the legend in FIGS. 2 and 3.

Figure 4:
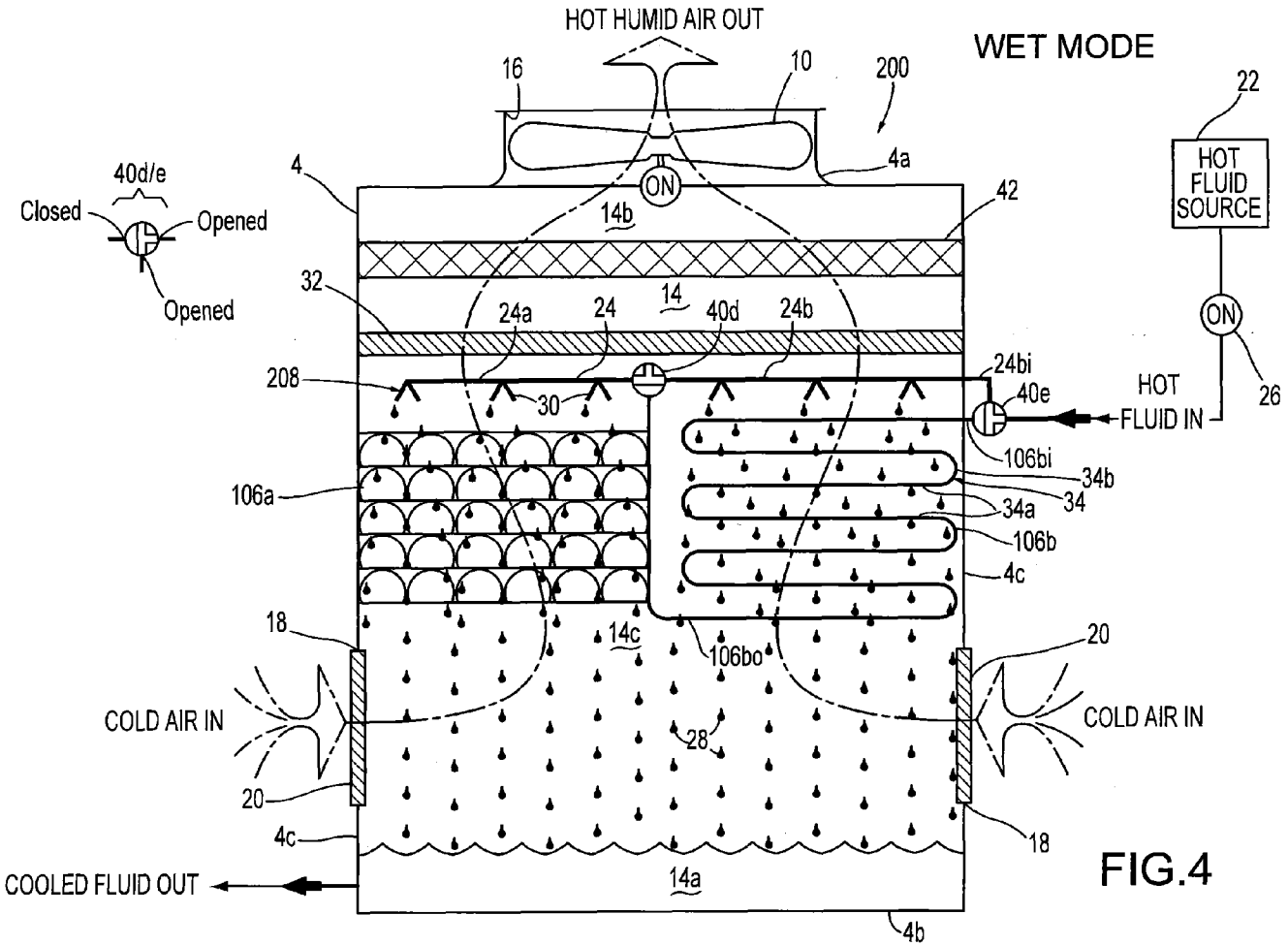
FIG. 4 is a schematic diagram of a second exemplary embodiment of a hybrid heat exchanger apparatus of the present invention operating in the wet mode.
Figure 5:
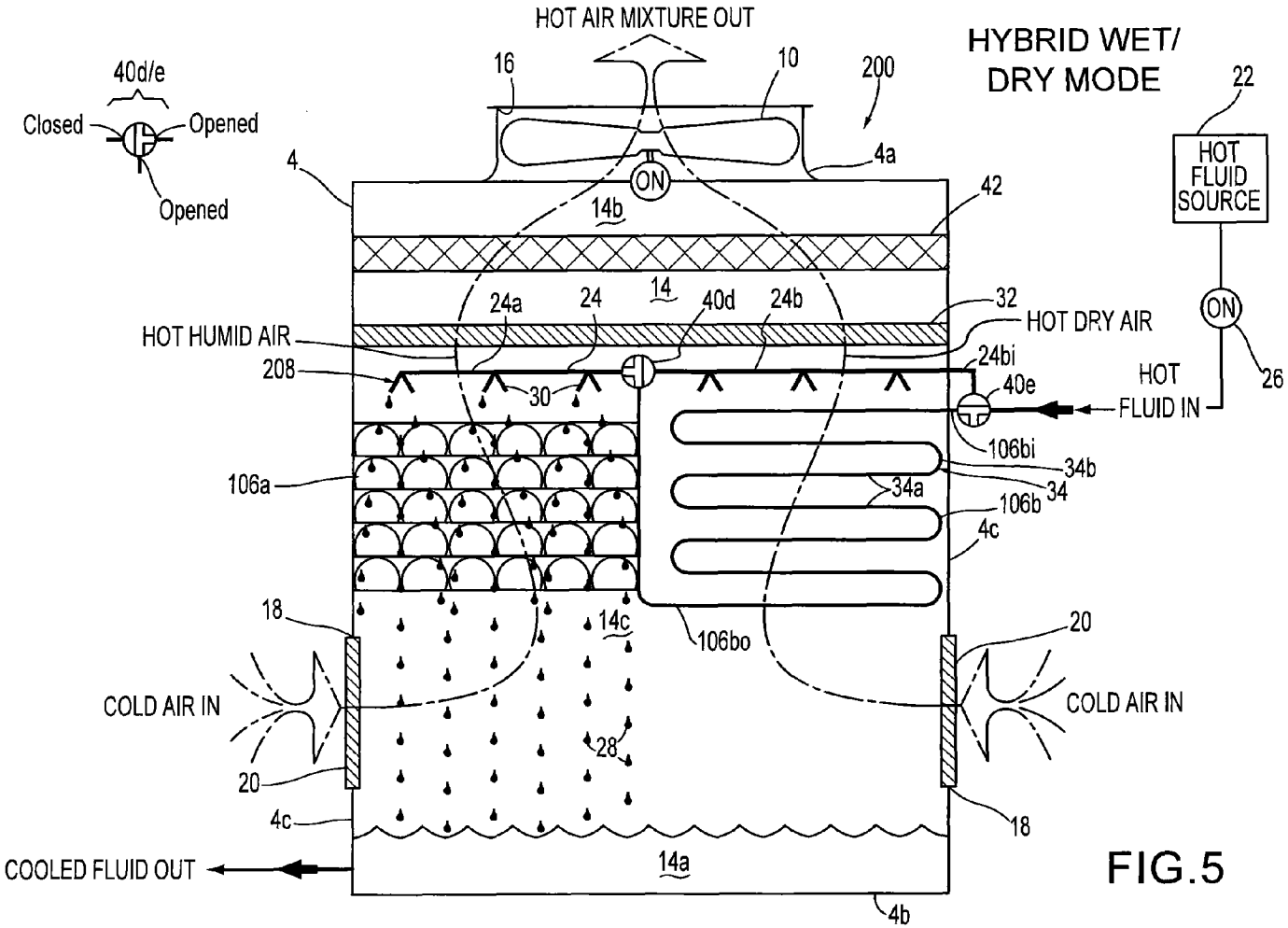
FIG. 5 is a schematic diagram of the second exemplary embodiment of the hybrid heat exchanger apparatus of the present invention operating in the hybrid wet/dry mode.

A second exemplary embodiment of a hybrid heat exchanger apparatus 200 is illustrated in FIGS. 4 and 5. The hybrid heat exchanger apparatus 200 includes a mixing baffle structure 42 that extends across the chamber 14 in the exit chamber portion 14*c* thereof. In FIG. 5, the mixing baffle structure 42 assists in mixing the HOT HUMID AIR and the HOT DRY AIR to form the HOT AIR MIXTURE preferably before it exits the air outlet 16. Furthermore, the hybrid heat exchanger apparatus 200 has a cooling fluid distribution system 208 that includes a first three-way valve 40*d* and a second three-way valve 40*e*. The first three-way valve 40*d* is interposed between the first fluid distribution manifold section 24*a* and the second fluid distribution manifold section 24*b* and downstream of the direct heat exchanger device outlet 106*bo* of the conventional direct heat exchanger device 106*b*. The second three-way valve 40*e* is disposed downstream of the pump 26 and upstream of a conventional indirect heat exchanger device inlet 106*bi* of the indirect heat exchanger device 106*b* and upstream of the second fluid distribution manifold section inlet 24*bi* of the second fluid distribution manifold section 24*b*.

In the WET mode shown in FIG. 4, the first three-way valve 40*d* is in the opened state to fluidically connect the first fluid distribution manifold section 24*a* and the second fluid distribution manifold section 24*b* and in the closed state to fluidically isolate the first fluid distribution manifold section 24*a* and the indirect heat exchanger 106. Simultaneously therewith, the second three-way valve 40*e* is in the opened state to fluidically connect the second fluid distribution manifold section 24*b* and the hot fluid source 22 and in the closed state to fluidically isolate the indirect heat exchanger device 106*b* and the first fluid distribution manifold section 24*a*. In the HYBRID WET/DRY mode, the first three-way valve 40*d* is in an opened state to fluidically connect the first fluid distribution manifold section 24*a* and the indirect heat exchanger 106*b* and in a closed state to fluidically isolate the first fluid distribution manifold section 24*a* and the second fluid distribution manifold section 24*b* and the second three-way valve 40*e* is in an opened state to fluidically connect the hot fluid source 22 and the indirect heat exchanger device 106*b* and in a closed state to fluidically isolate the second fluid distribution manifold section 24*b* from the hot fluid source 22.

A controller (not shown in FIGS. 4 and 5 but illustrated for example purposes in FIGS. 1-3) is operative to energize or de-energize the pump 26 and the fan assembly 10 by automatically or manually switching the pump 26 and the fan assembly 10 between an ON state and an OFF state and is also operative to move the first three-way valve 40*d* and the second three-way valve 40*e* to and between their respective opened and closed states. For sake of clarity of the drawing figures, the controller was intentionally not illustrated because one of ordinary skill in the art would appreciate that a controller can automatically change the ON and OFF states of the pump 26 and the fan assembly 10 and can change the opened and closed states of the valves. Alternatively, one of ordinary skill in the art would appreciate that the controller might be a human operator who can manually change the ON and OFF states of the pump 26 and the fan assembly 10 and can change the opened and closed states of the valves. As a result, rather than illustrating a controller, the ON and OFF states of the pump 26 and the fan assembly 10 and the opened and closed states of the valves are illustrated as a substitute therefor.

By way of example only and not by way of limitation, the hybrid heat exchanger apparatus 200 incorporates the indirect heat exchanger device 106*b* as a single, continuous tube structure formed in a serpentine configuration. However, all of the straight tube sections 34*a* are bare, i.e., none of the straight tube sections includes any fins. Further, the direct heat exchanger device 106*a* is a splash bar structure that is known in the art.

Figure 6:
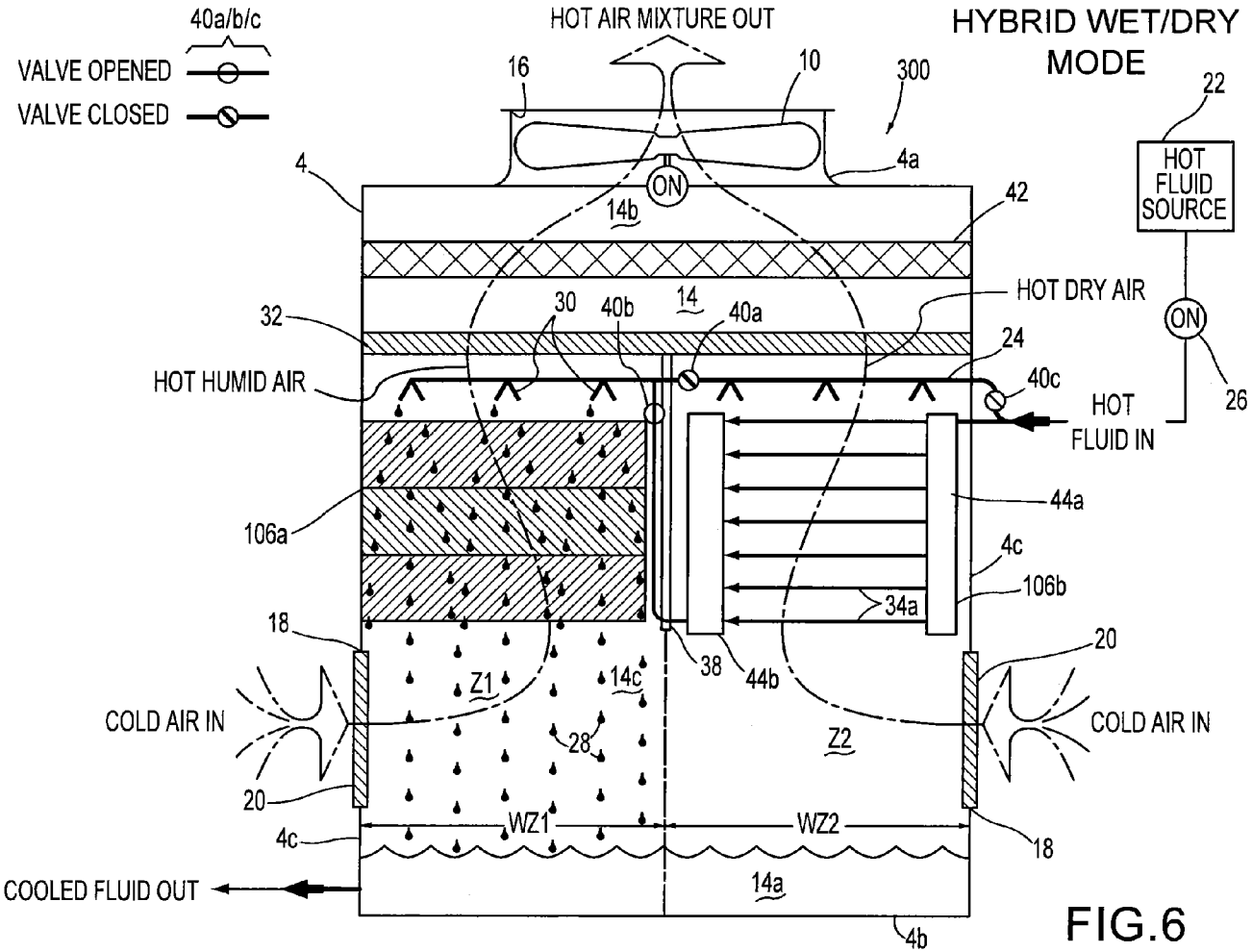
FIG. 6 is a schematic diagram of the third exemplary embodiment of the hybrid heat exchanger apparatus of the present invention operating in the hybrid wet/dry mode.

A third exemplary embodiment of a hybrid heat exchanger apparatus 300 of the present invention is introduced in FIG. 6 in the HYBRID WET/DRY mode only. Here, the tube structure is a bare, straight-through tube configuration. The bare, straight-through tubes interconnect an inlet header box 44*a* and an outlet header box 44*b* as is known in the art.

Further, the hybrid heat exchanger apparatus 300 includes a partition 38. The partition 38 is disposed between the direct heat exchanger 106*a* and the indirect heat exchanger 106*b* so as to vertically divide the direct heat exchanger device 106*a* and the indirect heat exchanger device 106*b*. When the hybrid heat exchanger apparatus 300 is in the HYBRID WET/DRY mode, the wet direct heat exchanger device 106*a* and the dry indirect heat exchanger device 106*b* are clearly delineated. As such, a first operating zone Z1 of the central chamber portion 14*c* and a second operating zone Z2 of the central chamber portion 14*c* juxtaposed to the first operating zone Z1 are defined. The first operating zone Z1 of the central chamber portion 14*c* has a horizontal first operating zone width WZ1 and the second operating zone Z2 of the central chamber portion 14*c* has a horizontal second operating zone width WZ2. By way of example only for the third exemplary embodiment of the hybrid heat exchanger apparatus 300 and the first and second exemplary embodiments of the hybrid heat exchanger apparatuses 100 and 200 illustrated in FIGS. 2-5, the horizontal first operating zone width WZ1 and the horizontal second operating zone width WZ2 are equal to or at least substantially equal to each other.

Figure 7:
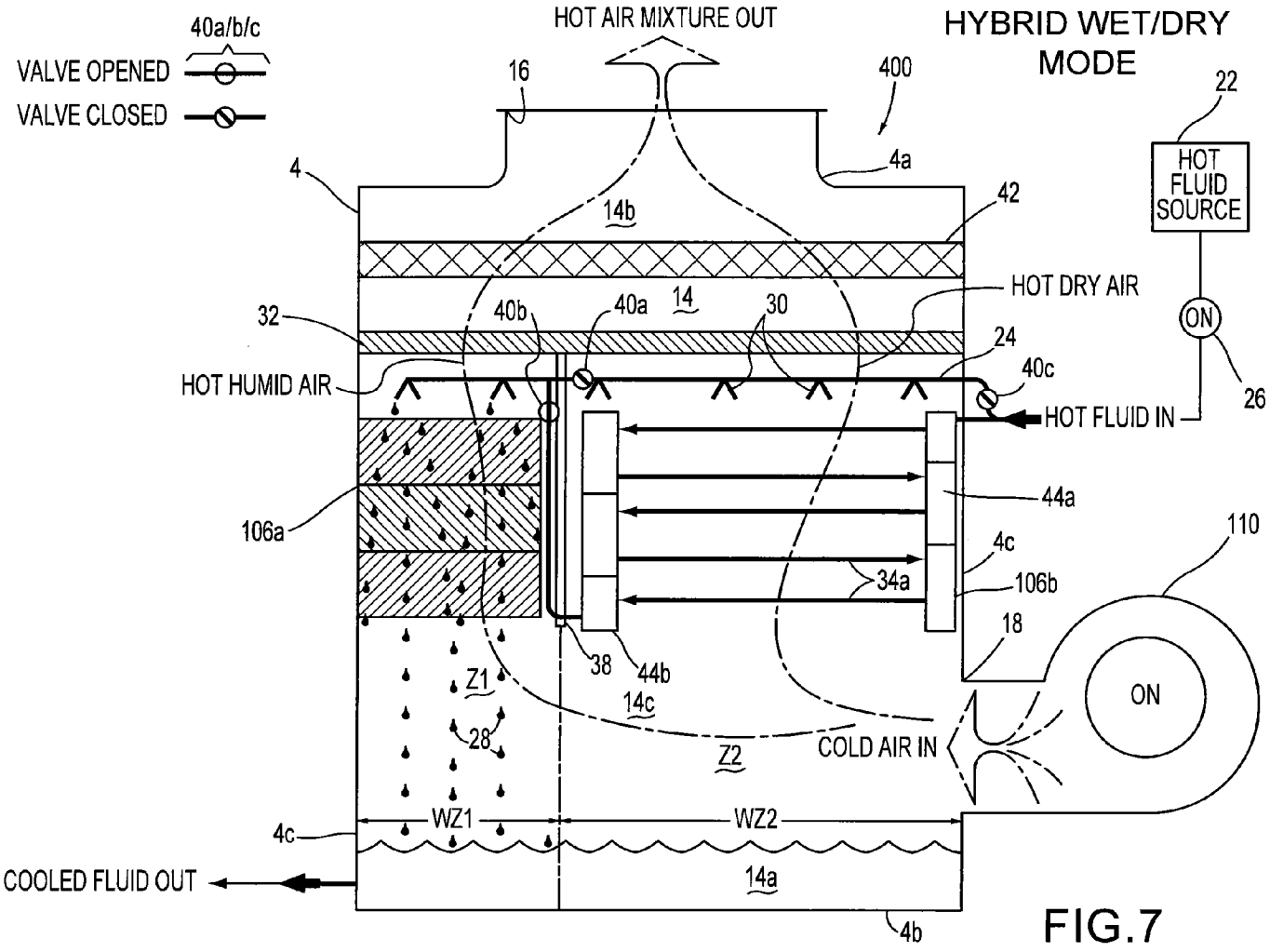
FIG. 7 is a schematic diagram of a fourth exemplary embodiment of the hybrid heat exchanger apparatus of the present invention operating in the hybrid wet/dry mode.

A fourth exemplary embodiment of a hybrid heat exchanger apparatus 400 of the present invention is introduced in FIG. 7 in the HYBRID WET/DRY mode only. Again, the tube structure is a bare, straight-through tube configuration. The bare, straight-through tubes interconnect the inlet header box 44*a* and the outlet header box 44*b* in a header-box configuration as is known in the art. Note that the hybrid heat exchanger apparatus 400 includes the partition 38. However, the horizontal first operating zone width WZ1 and the horizontal second operating zone width WZ2 are different from one another. More particularly, the horizontal first operating zone width WZ1 is smaller than the horizontal second operating zone width WZ2.

For the fourth exemplary embodiment of the hybrid heat exchanger apparatus 400 of the present invention, rather than an induced-draft fan assembly 10 as represented in FIGS. 1-6 shown mounted to the container 4 adjacent the air outlet 16, a fan assembly 110, sometimes referred to as a forced-air blower, is mounted at the air inlet 18 as an alternative air flow mechanism. Thus, rather than an induced air flow system as represented in FIGS. 1-6, the hybrid heat exchanger apparatus 400 is considered a forced air system.

Figure 8:
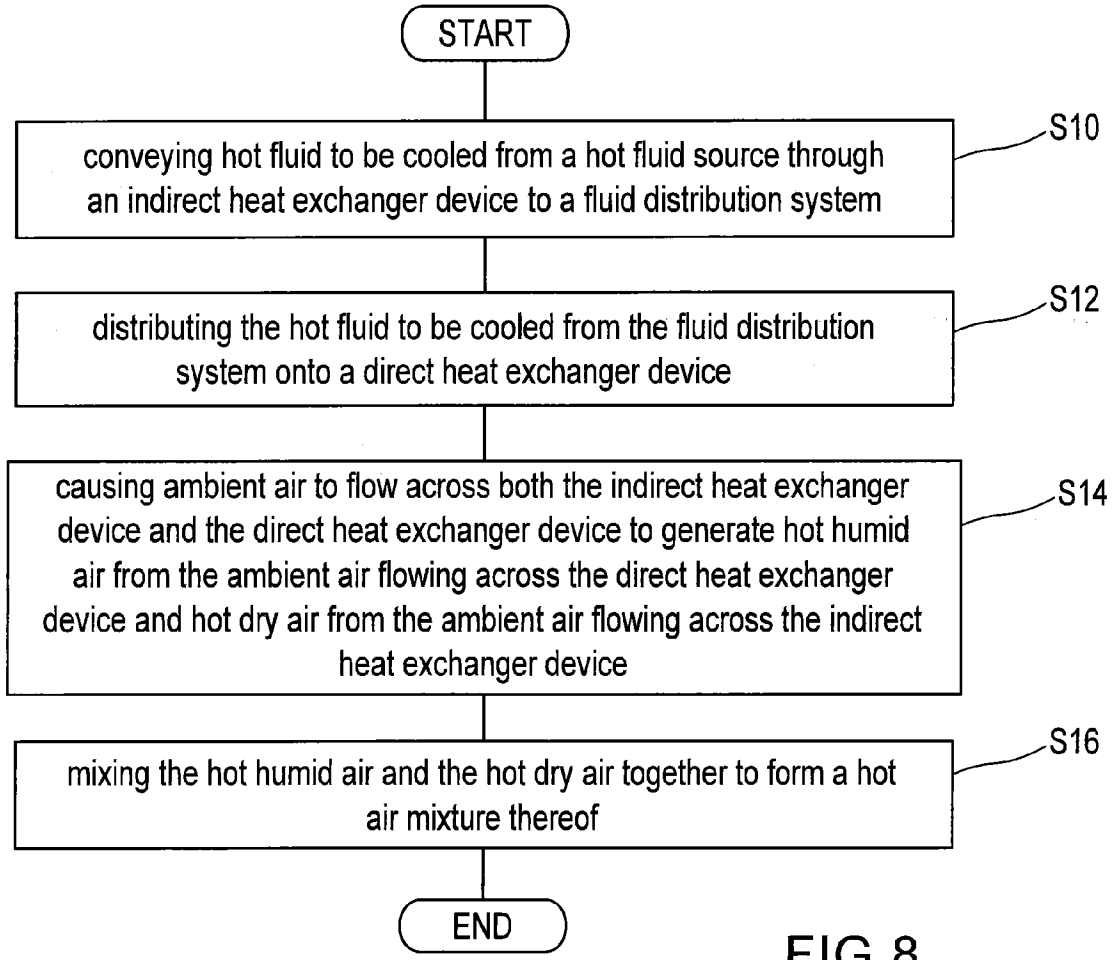
FIG. 8 is a flow diagram of a method of operating the hybrid heat exchanger apparatus of the first through fourth exemplary embodiments of the present invention.

In FIG. 8, a method for inhibiting formation of a water-based condensate from a heat exchanger apparatus for the first through the fourth exemplary embodiments of the present invention is described. The heat exchanger apparatus is operative for cooling a hot fluid to be cooled flowing from a hot fluid source and the heat exchanger apparatus has the indirect heat exchanger device 106*b*, the cooling fluid distribution system 108 and the direct heat exchanger device 106*a*. Step S10 conveys the hot fluid to be cooled (illustrated as a Hot Fluid IN arrow in FIGS. 2-7) from the hot fluid source 22 through the indirect heat exchanger device 106*b* to the cooling fluid distribution system 108. Step S12 distributes the hot fluid to be cooled (illustrated as a Hot Fluid IN arrow in FIGS. 2-7) from the cooling fluid distribution system 108 onto the direct heat exchanger device 106*a*. Step S14 causes ambient air (illustrated as the Cold Air IN arrow(s) in FIGS. 2-7) to flow across both the indirect heat exchanger device 106*b* and the direct heat exchanger device 106*a* to generate HOT HUMID AIR from the ambient air flowing across the direct heat exchanger device 106*a* and HOT DRY AIR from the ambient air flowing across the indirect heat exchanger device 106B. Step S16 mixes the HOT HUMID AIR and the HOT DRY AIR together to form a HOT AIR MIXTURE thereof. The HOT AIR MIXTURE exits the heat exchanger apparatus.

To enhance the method of the present invention, it might be beneficial to include yet another step. This step would provide the partition 38 that would extend vertically between the direct heat exchanger device 106*a* and the indirect heat exchanger device 106*b* in order to at least substantially delineate the first and second operating zones Z1 and Z2 between the direct heat exchanger device 106*a* and the direct heat exchanger device 106*b*.

Ideally, the HOT AIR MIXTURE of the HOT HUMID AIR and the HOT DRY AIR exits the hybrid heat exchanger apparatus either without a visible plume P (see FIG. 1) of the water-based condensate or at least substantially without a visible plume P of the water-based condensate. However, a skilled artisan would appreciate that, when the HOT AIR MIXTURE of the HOT HUMID AIR and the HOT DRY AIR exits the heat exchanger apparatus, visible wisps W of the water-based condensate as illustrated in FIG. 3 might appear exteriorly of the heat exchanger apparatus without departing from the spirit of the invention.

In order to execute the method of the present invention, the hybrid heat exchanger apparatus of the present invention adapted for cooling the hot fluid (illustrated as a Hot Fluid IN arrow) flowing from a hot fluid source 22 has the indirect heat exchanger device 106*b*, the cooling fluid distribution system 108 and the direct heat exchanger device 106*a*. The hybrid heat exchanger apparatus of the present invention includes a device such as the pump 26 for conveying the hot fluid to be cooled from the hot fluid source 22 through the indirect heat exchanger device 106*b* to the cooling fluid distribution system 108 and it associated fluid distribution manifold 24 for distributing the hot fluid to be cooled from the cooling fluid distribution system onto the direct heat exchanger device 106*a*. The hybrid heat exchanger apparatus of the present invention also includes an air flow mechanism such as the fan assemblies 10 and 110 for causing the ambient air to flow across both the indirect heat exchanger device 106*b* and the direct heat exchanger device 106*a* in order to generate the HOT HUMID AIR from the ambient air flowing across the direct heat exchanger device 106*a* and the HOT DRY AIR from the ambient air flowing across the indirect heat exchanger device106*b* and means for mixing the HOT HUMID AIR and the HOT DRY AIR together to form a HOT AIR MIXTURE thereof.

However, one of ordinary skill in the art would appreciate that induced-air and forced-air heat exchanger apparatuses have high-velocity air flowing therethrough. As a result, it is theorized that shortly after the ambient air passes across the respective ones of the direct and indirect heat exchanger devices, the HOT HUMID AIR and the HOT DRY AIR begin to mix. Furthermore, it is theorized that mixing also occurs as the HOT HUMID AIR and the HOT DRY AIR flow through the fan assembly 10 of the induced air system. Thus, it may not be necessary to add the mixing baffle structure 42 or any other device or structure to effectively mix the HOT HUMID AIR and the HOT DRY AIR into the HOT AIR MIXTURE in order to inhibit formation of a plume of condensed water as the HOT AIR MIXTURE exits the container 14.

To execute the method of the first through fourth exemplary embodiments of the present invention, the pump 26 is in fluid communication with only the first fluid distribution manifold section 24*a* and pumps the hot fluid to be cooled from the hot fluid source 22 to the first fluid distribution manifold section 24*a* via the indirect heat exchanger device 106*b* while the second fluid distribution manifold section 24*b* is in fluid isolation from the first fluid distribution manifold section 24*a* and the pump 26. Since the cooling fluid distribution system 108 includes the plurality of spray nozzles 30 that are connected to and in fluid communication with the fluid distribution manifold 24, the pump 26 pumps the hot fluid to be cooled to the first fluid distribution manifold section 24*a* of the fluid distribution manifold 24 via the indirect heat exchanger device 106*b* and through the plurality of spray nozzles 30. A skilled artisan would appreciate that the hot fluid source 22, the pump 226, the indirect heat exchanger device 106*b*, the first fluid distribution manifold section 24*a* and the direct heat exchanger device 106*a* in serially arranged in that order to execute the method of the present invention.

Figure 9:
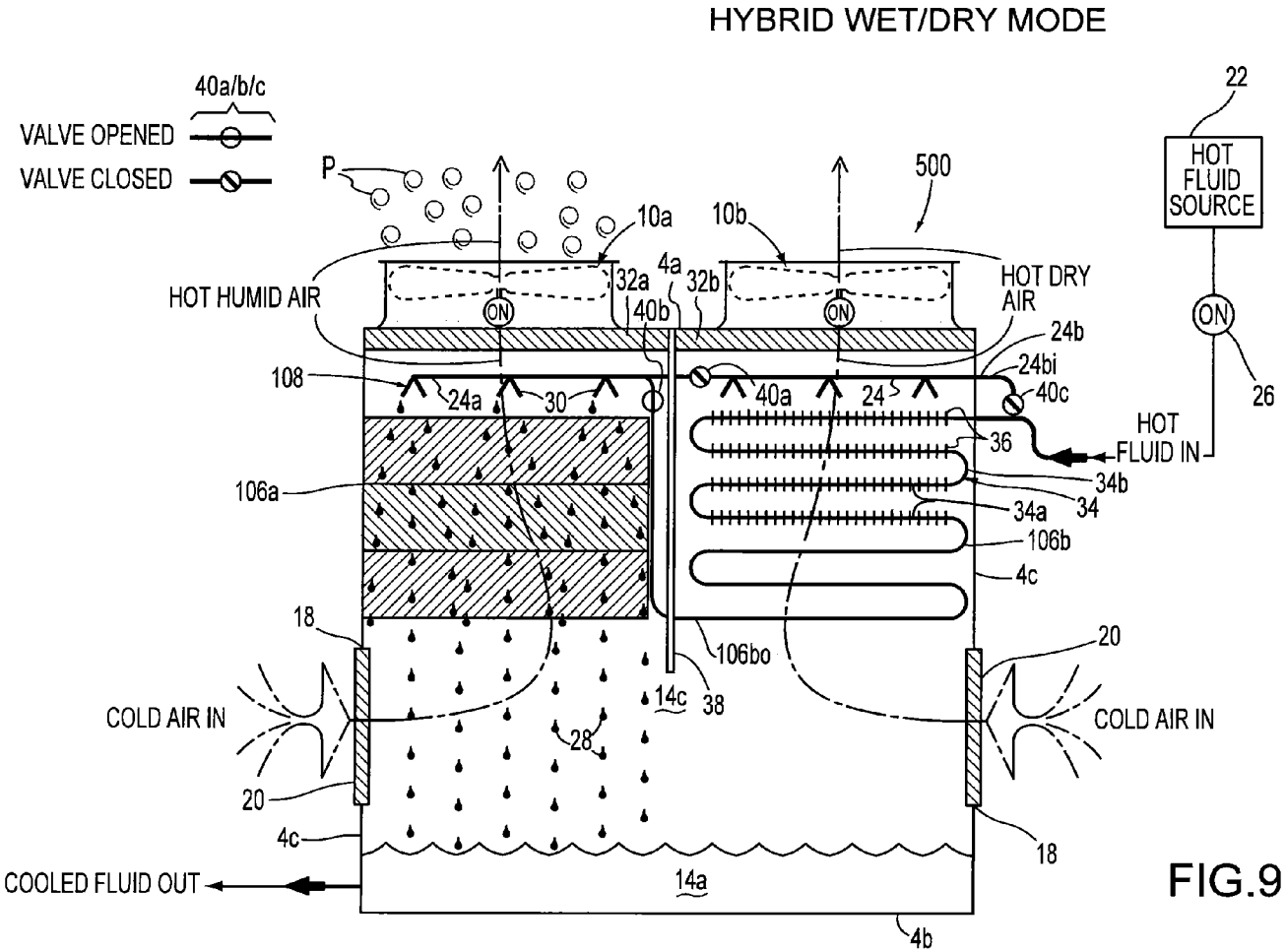
FIG. 9 is a schematic diagram of a fifth exemplary embodiment of the hybrid heat exchanger apparatus of the present invention operating in the hybrid wet/dry mode.
Figure 10:
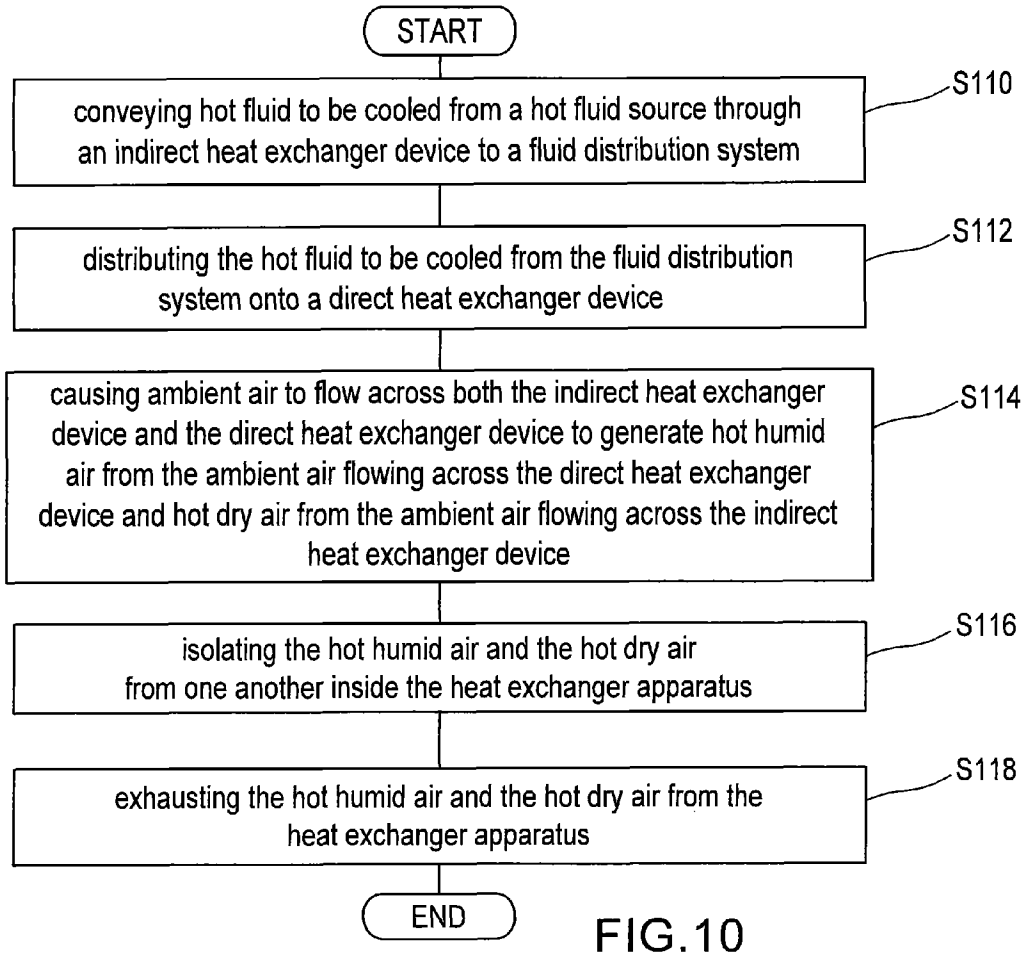
FIG. 10 is a flow diagram of a method of operating the hybrid heat exchanger apparatus of the fifth embodiment of the present invention.

A fifth exemplary embodiment of a hybrid heat exchanger apparatus 500 of the present invention in the HYBRID WET/DRY mode is illustrated in FIG. 9. By way of example only, the hybrid heat exchanger apparatus 500 includes a conventional direct heat exchanger device 106*a* that incorporates, by example only, fill material and a conventional indirect heat exchanger device 106*b* that incorporates a combination of straight tube sections 34*a*, some of which having fins 36 and some without fins. Note that the partition 38 is disposed between the direct heat exchanger device 106*a* and the indirect heat exchanger device 106*b* between first fluid distribution manifold section 24*a* and the second fluid distribution manifold section 24*b* and between a first eliminator structure section 32*a* and a second eliminator structure 32*b* and terminates in contact with the top wall 4*a* of the container 4. In effect, the partition 38 acts as an isolating panel that isolates the HOT HUMID AIR and the HOT DRY AIR from one another inside the heat exchanger apparatus 500.

Further, the hybrid heat exchanger apparatus 500 includes a first fan assembly 10*a* and a second fan assembly 10*b*. The first fan assembly 10*a* causes the ambient air to flow across the direct heat exchanger device 106*a* to generate the HOT HUMID AIR from the ambient air flowing across the wetted direct heat exchanger device 106*a*. The second fan assembly 10*b* causes the ambient air to flow across the indirect heat exchanger device 106*b* to generate the HOT DRY AIR from the ambient air flowing across the dry direct heat exchanger device 106*b*. Since the HOT HUMID AIR and the HOT DRY AIR are isolated from one another, the HOT HUMID AIR and the HOT DRY AIR are exhausted from the hybrid heat exchanger apparatus separately from one another. Specifically, the first fan assembly 10*a* exhausts the HOT HUMID AIR from the hybrid heat exchanger apparatus 500 and second fan assembly 10*b* exhausts the HOT DRY AIR from the hybrid heat exchanger apparatus 500.

Since the HOT HUMID AIR and the HOT DRY AIR are isolated from one another, it is possible that a plume P might form above the first fan assembly 10*a* under the appropriate atmospheric conditions. In brief, although the fifth embodiment of the hybrid heat exchanger apparatus 500 might not abate plume P, it does conserve water.

In order to execute the method of the ninth embodiment of hybrid heat exchanger apparatus 500 the present invention, the steps of distributing evaporative cooling water on the heat exchanger device and causing ambient air to flow across the heat exchanger device are identical to the method to execute the method of the first through fourth embodiments of the hybrid heat exchanger device described above. In addition thereto, to execute the method of the fifth embodiment of the hybrid heat exchanger device 500, the HOT HUMID AIR and the HOT DRY AIR are isolated from one another inside the hybrid heat exchanger apparatus and thereafter the HOT HUMID AIR and HOT DRY AIR are then exhausted from the hybrid heat exchanger apparatus as separate air-flow streams.

For the embodiments of the hybrid heat exchanger apparatus of the present invention, water conservation is achieved primarily in two ways. First, a lesser amount of the hot fluid to be cooled is used when the hybrid heat exchanger apparatus is in the HYBRID WET/DRY mode than in the WET mode. For example, compare FIGS. 2 and 3. Second, a lesser amount of evaporation of the hot fluid to be cooled occurs in the HYBRID WET/DRY mode than in the WET mode. To further explain, in the HYBRID WET/DRY mode, an upstream portion of the hot fluid to be cooled flowing through the indirect heat exchanger device is cooled upstream by dry cooling and a downstream portion of the hot fluid (that has already flowed through the upstream indirect heat exchanger device and cooled by dry cooling) is further cooled by evaporative cooling from a wetted direct heat exchanger device located downstream the indirect heat exchanger device. Thus, the embodiments of the hybrid heat exchanger apparatus are considered to have enhanced dry cooling capabilities in the HYBRID WET/DRY mode for conservation of water and, possibily, for abatement of plume.

Figure 11:
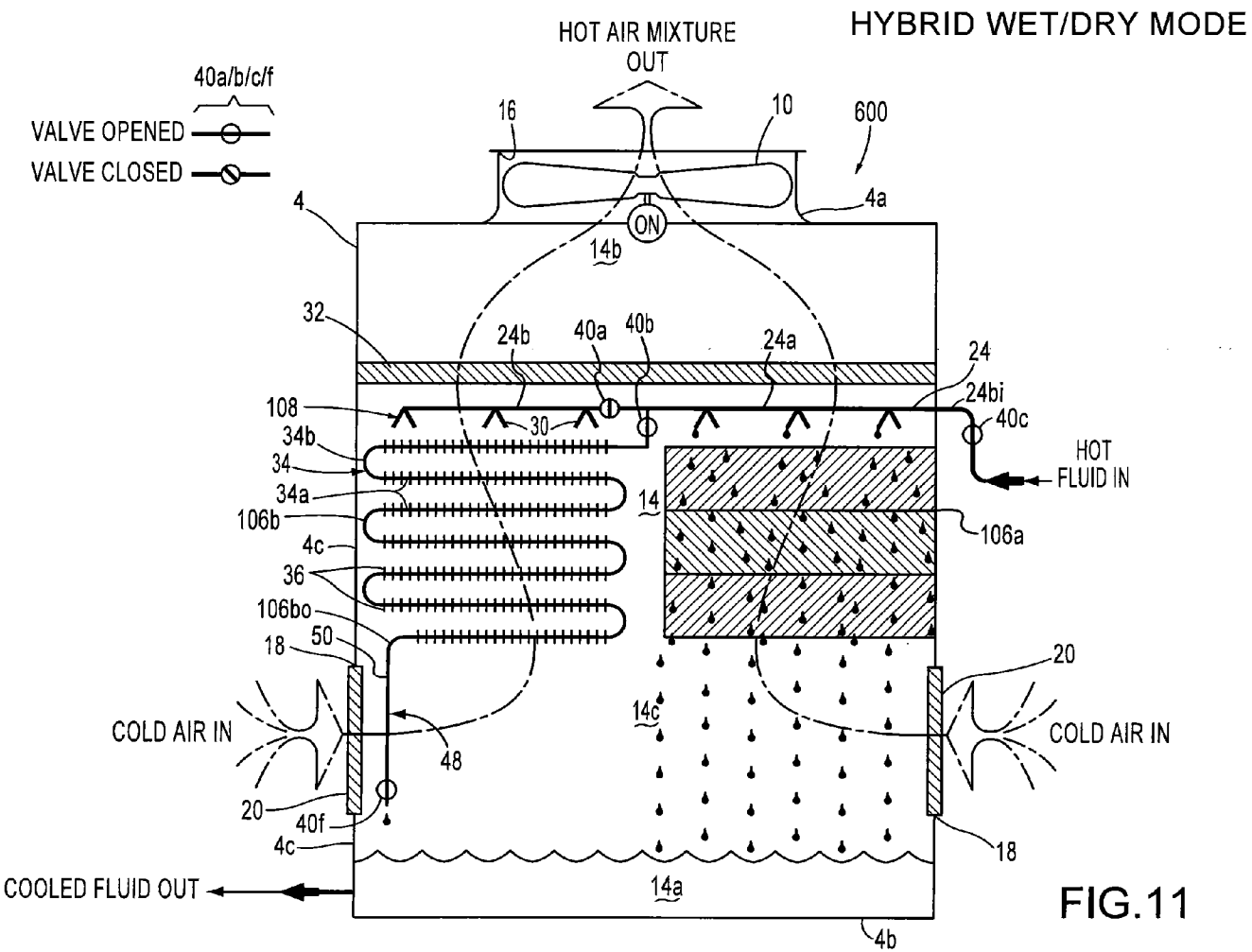
FIG. 11 is a schematic diagram of a sixth exemplary embodiment of the hybrid heat exchanger apparatus of the present invention operating in the hybrid wet/dry mode.

A sixth exemplary embodiment of a hybrid heat exchanger apparatus 600 is illustrated in FIG. 11 in its HYBRID WET/DRY mode. Note that the direct heat exchanger device 106*a* is disposed in a juxtaposed manner upstream of the indirect heat exchanger device 106*b*. As a result, the direct heat exchanger device 106*a* is wetted with a portion of the hot fluid to be cooled illustrated as a Hot Fluid IN arrow and a remaining portion of the hot fluid to be cooled is conveyed through the indirect heat exchanger device 106*b* without being wetted itself. And, as described above, ambient air flows across both the indirect heat exchanger device 106*b* and the direct heat exchanger device 106*a* to generate HOT HUMID AIR from the ambient air flowing across the direct heat exchanger device 106*a* and HOT DRY AIR from the ambient air flowing across the indirect heat exchanger device 106*b*.

Additionally, the sixth exemplary embodiment of the hybrid heat exchanger apparatus 600 includes a drain assembly 48. The drain assembly 48 includes a drain pipe 50 and a drain valve 40*f*. The drain pipe 50 is connected at one end to and in fluid communication with the indirect heat exchanger device outlet 106*bo* of the indirect heat exchanger device 106*b* and at an opposite end with the drain valve 40*f*. With the drain valve 40*f* in the valve opened state, the remaining portion of the hot fluid to be cooled (which is now cooled fluid) drains out of the indirect heat exchanger device 106*b* and into the water basin chamber portion 14*a*.

Figure 12:
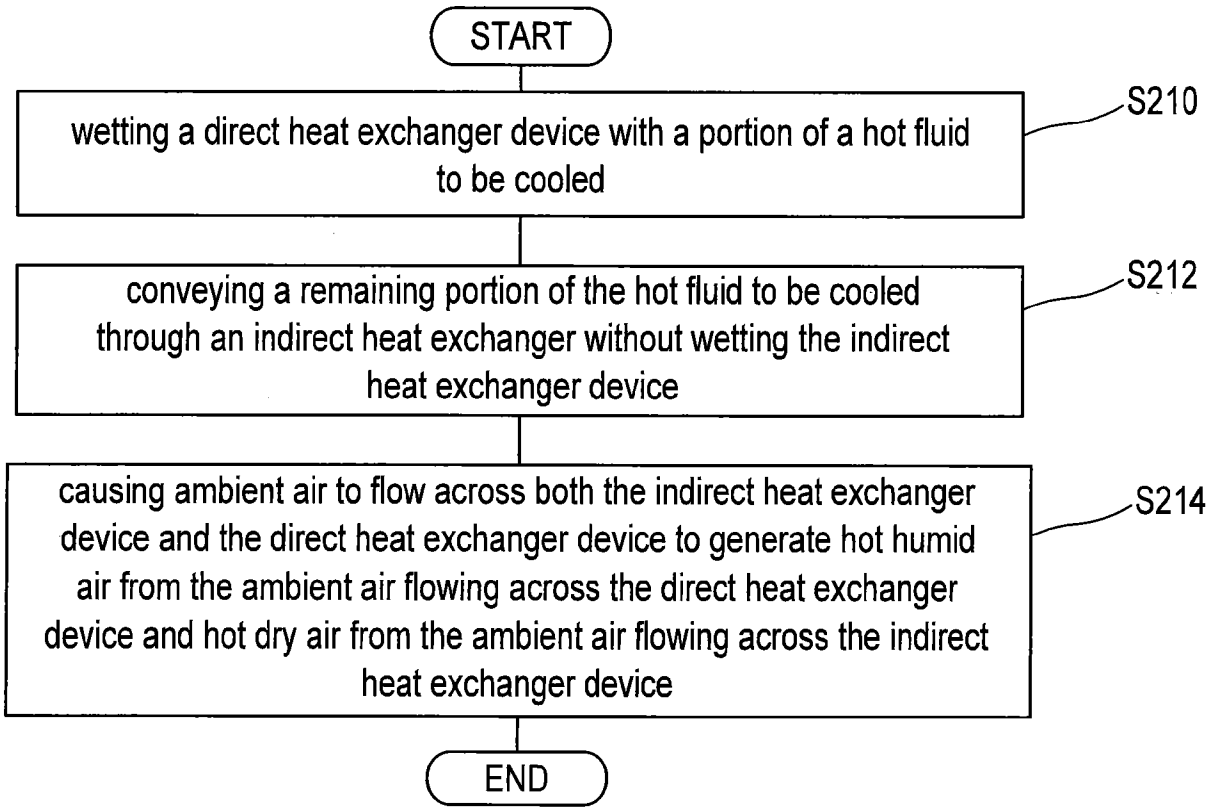
FIG. 12 is a flow diagram of a method of operating the hybrid heat exchanger apparatus of the sixth exemplary embodiment of the present invention.

For the sixth exemplary embodiment of the hybrid heat exchanger device 600 of the present invention, a method inhibits formation of a water-based condensate from the hybrid heat exchanger apparatus 600 that cools the hot fluid to be cooled flowing from the hot fluid source 22. The steps for executing this method are illustrated in FIG. 12. In step 210, the direct heat exchanger device 106*a* is wetted with a portion of the hot fluid to be cooled. In step 212, a remaining portion of the hot fluid to be cooled is conveyed through the indirect heat exchanger 106*b* without wetting the indirect heat exchanger 106*b*. In step, 214, ambient air is caused to flow across both the indirect heat exchanger device 106*b* and the direct heat exchanger device 106*a* to generate HOT HUMID AIR from the ambient air flowing across the direct heat exchanger device 106*a* and HOT DRY AIR from the ambient air flowing across the indirect heat exchanger device 106*b*.

Figure 13:
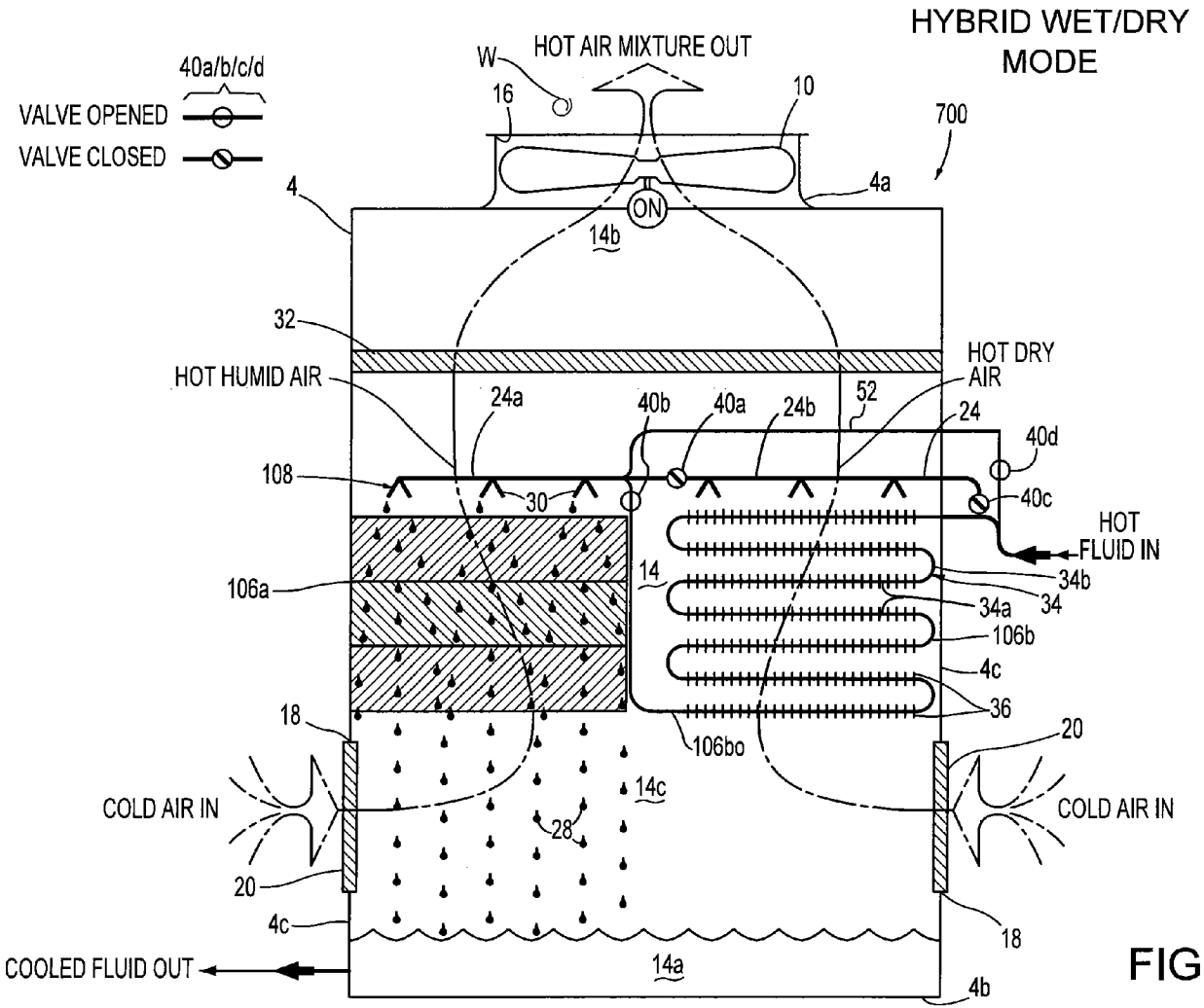
FIG. 13 is a schematic diagram of a seventh exemplary embodiment of the hybrid heat exchanger apparatus of the present invention operating in the hybrid wet/dry mode.

A seventh exemplary embodiment of a hybrid heat exchanger apparatus 700 of the present invention in the HYBRID WET/DRY mode is illustrated in FIG. 13. The seventh exemplary embodiment of the hybrid heat exchanger apparatus 700 is similar to the first exemplary embodiment of the hybrid heat exchanger apparatus 100 discussed above and illustrated in FIG. 3. Unlike the first exemplary embodiment of the hybrid heat exchanger apparatus 10, the seventh embodiment of the hybrid heat exchanger apparatus 700 includes a restricted bypass 52. The restricted bypass 52 interconnects the hot fluid source 22 (shown in FIGS. 2 and 3) and the first fluid distribution manifold section 24*a* while bypassing the second fluid distribution manifold section 24*b*. Although the hot fluid to be cooled flows through the indirect heat exchanger device 106*b*, the restricted bypass 52 is operative to restrict the hot fluid to be cooled to flow though the indirect heat exchanger device 106*b*. The valve 40*d* can be partially closed so that only a portion of the hot fluid to be cooled flows through the indirect heat exchanger 106*b*. A skilled artisan would appreciate that the valve 40*d* might be an orifice plate or some other conventional flow restriction device to accomplish the same object as the valve 40*d*.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art. For instance, although the drawing figures depict the first operating zone Z1 as a wet zone and the second operating zone Z2 as a dry zone, it is possible, with mechanical adjustments in some instances and without mechanical adjustments in other instances, it is possible that the first operating zone Z1 is a dry zone and the second operating zone Z2 is a wet zone. Furthermore, it will be appreciated that either all, some or none of the objects, benefits and advantages of the invention are incorporated into the various claimed features of the invention.

What is claimed is:

1. A method for inhibiting formation of a water-based condensate from a heat exchanger apparatus operative for cooling a hot fluid to be cooled flowing from a hot fluid source, the heat exchanger apparatus having a cabinet portion, at least one air inlet opening at a bottom portion thereof and an air outlet opening at a top portion thereof, the cabinet portion forming an air-tight conduit disposed and extending between the at least one air inlet opening and the air outlet opening and defining an enclosed conduit space, the method comprising the steps of:

providing the heat exchanger apparatus with a fluid distribution manifold, an indirect heat exchanger device and a direct heat exchanger device disposed in the enclosed conduit space such that:

the fluid distribution manifold has a first fluid distribution manifold section and a second fluid distribution manifold section with the first and second distribution manifold sections being in selective fluid communication with each other, each one of the first and second distribution manifold sections including a plurality of spray nozzles oriented relative to each other to define a common horizontal plane in the enclosed conduit space;

the indirect heat exchanger device and the direct heat exchanger device are positioned horizontally juxtaposed to one another and adjacent to and below the common horizontal plane with the indirect heat exchanger positioned adjacent to and below the first fluid distribution manifold section and the direct heat exchanger positioned adjacent to and below the second fluid distribution manifold with the fluid distribution manifold, the indirect heat exchanger device and the direct heat exchanger device disposed above the at least one air inlet opening and below the air outlet opening as viewed in cross-section; and a partition extending vertically and disposed between the indirect heat exchanger device and the direct heat exchanger device to terminate at a partition top end at or above the common horizontal plane and to terminate at an opposing partition bottom end at or below respective bottom portions of the indirect and direct heat exchanger devices;

conveying the hot fluid to be cooled from the hot fluid source through the indirect heat exchanger device to the fluid distribution manifold;

distributing the hot fluid to be cooled from the second distribution manifold onto the direct heat exchanger device; and causing ambient air to flow upwardly from the at least one air inlet opening and into a first ambient airstream flowing across the direct heat exchanger device to generate a hot humid airstream and into a second ambient airstream flowing across the indirect heat exchanger device to generate a hot dry airstream in a manner that the hot humid airstream and the hot dry airstream flow upwardly and parallel to each other;

after the hot humid airstream and the hot dry airstream flow upwardly across respective ones of the direct heat exchanger device and the indirect heat exchanger device and past the partition top end, mixing the hot humid airstream and the hot dry air stream into a hot air mixture; and causing the hot air mixture to flow out of the heat exchanger apparatus from the enclosed conduit space through the air outlet opening, wherein the partition fluidically isolates the first and second ambient airstreams from one another commencing at the partition bottom end, continues to fluidically isolate respective ones of the first and second ambient airstreams as the respective ones of the first and second ambient airstreams transform into respective ones of the hot humid airstream and the hot dry airstream and terminates fluidic isolation of the hot humid airstream and the hot dry airstream as the hot humid airstream and the hot dry airstream flow past the partition top end.

2. A method according to claim 1, wherein the hot air mixture of the hot humid air and the hot dry air flows out of the heat exchanger apparatus at least substantially without a visible plume of the water-based condensate.

3. A method according to claim 2, wherein when the hot air mixture of the hot humid air and the hot dry air flows out of the heat exchanger apparatus, visible wisps of the water-based condensate appear exteriorly of the heat exchanger apparatus.

4. A hybrid heat exchanger apparatus adapted for cooling a hot fluid to be cooled from a hot fluid source, the hybrid heat exchanger apparatus comprising:

a container having a top wall, a bottom wall and a plurality of side walls connected to the top and bottom wall to form a cabinet defining a generally box-shaped chamber, the chamber having a water basin chamber portion defined, in part, by the bottom wall for containing cooled fluid, an exit chamber portion defined, in part, by the top wall and a central chamber portion defined, in part, between opposing ones of the side walls and positioned between the water basin chamber portion and the exit chamber portion, the top wall being formed with an air outlet in communication with the exit chamber portion, at least one side wall formed with an air inlet in communication with the central chamber portion, the cabinet including a cabinet portion forming an air-tight conduit disposed and extending between the air outlet and the air inlet and defining an enclosed conduit space;

a direct heat exchanger device disposed in the enclosed conduit space and extending partially across the central chamber portion adjacent to and below the exit chamber portion and operative to convey the hot fluid to be cooled therethrough from cooling fluid distribution system;

an indirect heat exchanger device disposed in the enclosed conduit space and extending partially across the central chamber portion adjacent to and below the exit chamber portion and operative to be in selective fluid communication with the direct heat exchanger device with the indirect heat exchanger and the direct heat exchanger being positioned horizontally juxtaposed to one another and with the fluid distribution manifold, the indirect heat exchanger device and the direct heat exchanger device disposed above the at least one air inlet and below the air outlet as viewed in cross-section;

a cooling fluid distribution system disposed in the enclosed conduit space and including a fluid distribution manifold extending across the central chamber portion and having a first fluid distribution manifold section disposed above and adjacent to the direct heat exchanger device and a second fluid distribution manifold section in selective fluid communication with the first fluid distribution manifold section and disposed above and adjacent to the indirect heat exchanger device, each one of the first and second distribution manifold sections including a plurality of spray nozzles oriented relative to each other to define a horizontal plane disposed adjacent to and above the direct and indirect heat exchanger devices in the enclosed conduit space;

a pump operative for pumping the hot fluid to be cooled from the hot fluid source to the first fluid distribution manifold section via the indirect heat exchanger device or to the first fluid distribution manifold section via the second fluid distribution manifold section;

an air flow mechanism operative for causing ambient air to flow upwardly through the hybrid heat exchanger apparatus from the air inlet, through the cabinet portion across the indirect and direct heat exchanger devices and the fluid distribution manifold and through the air outlet from the enclosed conduit space;

a partition extending vertically and disposed between the indirect heat exchanger device and the direct heat exchanger device to terminate at a partition top end at or above the common horizontal plane and to terminate at an opposing partition bottom end at or below respective bottom portions of the indirect and direct heat exchanger devices; and a controller operative for causing the hybrid heat exchanger apparatus to operate in one of a wet mode and a hybrid wet/dry mode, wherein, in the wet mode, the air flow mechanism and the pump are energized in their respective ON states while the indirect heat exchanger and the direct heat exchanger are in fluid isolation from one another and the first fluid distribution manifold section and the second fluid distribution manifold section are in fluid communication with each other resulting in the ambient air flowing across the indirect heat exchanger device and the direct heat exchanger device so that the hot fluid to be cooled is distributed to wet the direct heat exchanger device from the first fluid distribution manifold section and to wet the indirect heat exchanger device from the second fluid distribution manifold section in order to generate hot humid air that subsequently exits from the enclosed conduit space through the air outlet, and in the hybrid wet/dry mode, both the air flow mechanism and the pump are energized in their respective ON states while the indirect heat exchanger device and the first fluid distribution manifold section are in fluid communication and the first fluid distribution manifold section and the second fluid distribution manifold section are in fluid isolation from one another resulting in the ambient air to flow upwardly from the air inlet and into a first ambient airstream flowing across the direct heat exchanger device to generate a hot humid airstream and into a second ambient airstream flowing across the indirect heat exchanger device to generate a hot dry airstream so that the hot fluid to be cooled is distributed to wet the direct heat exchanger device from the first fluid distribution manifold section in order to generate the hot humid airstream while allowing the indirect heat exchanger device to be dry in order to generate the hot dry airstream in a manner such that the hot humid airstream and the hot dry airstream flow upwardly and parallel to each other as the hot humid airstream and the hot dry air airstream flow upwardly across respective ones of the direct heat exchanger device and the indirect heat exchanger device, wherein the air flow mechanism causes the hot humid airstream and the hot dry airstream to mix together to form a hot air mixture that flows out of the heat exchanger apparatus from the enclosed conduit space through the air outlet and wherein the partition fluidically isolates the first and second ambient airstreams from one another commencing at the partition bottom end, continues to fluidically isolate respective ones of the first and second ambient airstreams as the respective ones of the first and second ambient airstreams transform into respective ones of the hot humid airstream and the hot dry airstream and terminates fluidic isolation of the hot humid airstream and the hot dry airstream as the hot humid airstream and the hot dry airstream flow past the partition top end.

5. A hybrid heat exchanger apparatus according to claim 4, wherein, when the hybrid heat exchanger apparatus is in the hybrid wet/dry mode, the wet direct heat exchanger device and the dry indirect heat exchanger device are delineated to define a first operating zone of the central chamber portion and a second operating zone of the central chamber portion juxtaposed to the first operating zone.

6. A hybrid heat exchanger apparatus according to claim 5, wherein the partition is disposed in the hybrid heat exchanger apparatus in a manner to isolate the hot humid air and the hot dry air from one another inside the heat exchanger apparatus so that the hot humid air and the hot dry air are exhausted separately from the hybrid heat exchanger apparatus.

7. A hybrid heat exchanger apparatus according to claim 5, wherein the first operating zone of the central chamber portion has a horizontal first operating zone width and the second operating zone of the central chamber portion has a horizontal second operating zone width, the horizontal first operating zone width and the horizontal second operating zone width being one of equal to each other and different from one another.

8. A hybrid heat exchanger apparatus according to claim 4, wherein the indirect heat exchanger device is a tube structure and the direct heat exchanger device is one of a fill material structure and a splash bar structure.

9. A hybrid heat exchanger apparatus according to claim 8, wherein the tube structure is one of a serpentine tube configuration, a header-box configuration and a straight-through configuration.

10. A hybrid heat exchanger apparatus according to claim 9, wherein the tube structure includes either a plurality of finned tubes or a plurality of bare tubes.

11. A hybrid heat exchanger apparatus according to claim 4, wherein the cooling fluid distribution system includes a first three-way valve and a second three-way valve, the first three-way valve interposed between the first fluid distribution manifold section and the second fluid distribution manifold section and downstream of a direct heat exchanger device outlet of the direct heat exchanger device, the second three-way valve being disposed downstream of the pump and upstream of an indirect heat exchanger device inlet of the indirect heat exchanger device and upstream of a second fluid distribution manifold section inlet of the second fluid distribution manifold section.

12. A hybrid heat exchanger apparatus according to claim 11, wherein, in the hybrid wet/dry mode, the first three-way valve is in an opened state to fluidically connect the first fluid distribution manifold section and the indirect heat exchanger and in a closed state to fluidically isolate the first and second fluid distribution manifold sections and the second three-way valve is in an opened state to fluidically connect the hot fluid source and the indirect heat exchanger device and in a closed state to fluidically isolate the second fluid distribution manifold section from the hot fluid source and, in the wet mode, the first three-way valve is in the opened state to fluidically connect the first fluid distribution manifold section and the second fluid distribution manifold section and in the closed state to fluidically isolate the first fluid distribution manifold section and the indirect heat exchanger and the second three-way valve is in the opened state to fluidically connect the second fluid distribution manifold section and the hot fluid source and in the closed state to fluidically isolate the indirect heat exchanger device and the first fluid distribution manifold section.

13. A hybrid heat exchanger apparatus according to claim 12, wherein the controller is operative to energize or de-energize at least one of the pump and the air flow mechanism by automatically or manually switching the at least one of the pump and the air flow mechanism between an ON state and an OFF state and operative to move the first three-way valve and the second three-way valve to and between their respective opened and closed states.

14. A hybrid heat exchanger apparatus according to claim 4, wherein the cooling fluid distribution system includes a first valve, a second valve and a third valve, the first valve interposed between the first fluid distribution manifold section and the second fluid distribution manifold section, the second valve disposed downstream of an indirect heat exchanger device outlet of the indirect heat exchanger device and between the first and second fluid distribution manifold sections, the third valve being disposed downstream of the pump and upstream of a second fluid distribution manifold section inlet of the second fluid distribution manifold section.

15. A hybrid heat exchanger apparatus according to claim 14, wherein, in the hybrid wet/dry mode, the first valve is in a closed state to fluidically isolate the first and second fluid distribution manifold sections, the second valve is in an opened state to fluidically connect the first fluid distribution manifold section and the indirect heat exchanger device and the third valve is in the closed state to fluidically isolate the second fluid distribution manifold section and the hot fluid source and, in the wet mode, the first valve is in an opened state to fluidically connect the first and second fluid distribution manifold sections, the second valve is in a closed state to fluidically isolate the first fluid distribution manifold section and the indirect heat exchanger device and the third valve is in the opened state to fluidically connect the hot fluid source and the second fluid distribution manifold section.

16. A hybrid heat exchanger apparatus according to claim 15, wherein the controller is operative to energize or de-energize at least one of the pump and the air flow mechanism by automatically or manually switching the at least one of the pump and the air flow mechanism between an ON state and an OFF state and operative to move the first valve, the second valve and the third valve to and between their respective opened and closed states.

17. A hybrid heat exchanger apparatus according to claim 4, further comprising an eliminator structure extending across the chamber and disposed between the fluid distribution manifold and the air outlet with the exit chamber portion of the chamber disposed above the eliminator structure and the central chamber portion of the chamber disposed below the eliminator structure.

18. A hybrid heat exchanger apparatus according to claim 4, further comprising a mixing baffle structure extending across the chamber in the exit chamber portion thereof.

19. A hybrid heat exchanger apparatus according to claim 4, further comprising at least one louver module mounted to one of the plurality of the side walls in the air inlet, disposed adjacent to and above the water basin chamber portion and operative to permit ambient air to enter into the central chamber portion.

20. A hybrid heat exchanger apparatus according to claim 4, wherein each spray nozzle is operatively connected to the at least one water distribution fluid distribution manifold.

21. A hybrid heat exchanger apparatus according to claim 4, further comprising a restricted bypass interconnecting the hot fluid source and the first fluid distribution manifold section while bypassing the second fluid distribution manifold section and operative to restrict the hot fluid to be cooled to flow though the indirect heat exchanger device.

22. A hybrid heat exchanger apparatus according to claim 4, wherein the pump is operative to pressurize the hot fluid to be cooled from the hot fluid source so that the hot fluid to be cooled from the hot fluid source is conveyed under pressure to the first fluid distribution manifold section.

23. A hybrid heat exchanger apparatus according to claim 4, wherein the indirect heat exchanger device includes a serpentine tube having a plurality of straight sections and a plurality of return-bend sections, respective ones of the plurality of return-bend sections interconnecting respective ones of the plurality of straight sections, each one of the plurality of straight sections extending generally along a horizontal direction within the enclosed conduit space.

24. A method for inhibiting formation of a water-based condensate from a heat exchanger apparatus operative for cooling a hot fluid to be cooled flowing from a hot fluid source, the heat exchanger apparatus having a cabinet portion, at least one air inlet opening at a bottom portion thereof and an air outlet opening at a top portion thereof, the cabinet portion forming an air-tight conduit disposed and extending between the at least one air inlet opening and the air outlet opening and defining an enclosed conduit space, the method comprising the steps of:

providing the heat exchanger apparatus with a fluid distribution manifold, an indirect heat exchanger device and a direct heat exchanger device disposed in the enclosed conduit space such that:

the fluid distribution manifold has a first fluid distribution manifold section and a second fluid distribution manifold section with the first and second distribution manifold sections being in selective fluid communication with each other, each one of the first and second distribution manifold sections including a plurality of spray nozzles oriented relative to each other to define a common horizontal plane in the enclosed conduit space;

the indirect heat exchanger device and the direct heat exchanger device are positioned horizontally juxtaposed to one another and adjacent to and below the common horizontal plane with the indirect heat exchanger positioned adjacent to and below the first fluid distribution manifold section and the direct heat exchanger positioned adjacent to and below the second fluid distribution manifold, the indirect heat exchanger device and the direct heat exchanger device disposed above the at least one air inlet opening and below the air outlet opening as viewed in cross-section; and a partition extending vertically and disposed between the indirect heat exchanger device and the direct heat exchanger device to terminate at a partition top end at or above the common horizontal plane and to terminate at an opposing partition bottom end at or below respective bottom portions of the indirect and direct heat exchanger devices;

wetting the direct heat exchanger device with a portion of the hot fluid to be cooled;

conveying a remaining portion of the hot fluid to be cooled through the indirect heat exchanger device without wetting the indirect heat exchanger device; and causing ambient air to flow upwardly from the at least one air inlet opening and into a first ambient airstream flowing across the direct heat exchanger device to generate a hot humid airstream and into a second ambient airstream flowing across the indirect heat exchanger device to generate a hot dry airstream in a manner that the hot humid airstream and the hot dry airstream flow upwardly and parallel to each other;

after the hot humid airstream and the hot dry air airstream flow upwardly across respective ones of the direct heat exchanger device and the indirect heat exchanger device and past the partition top end, mixing the hot humid airstream and the hot dry air stream into a hot air mixture; and causing the hot air mixture to flow out of the heat exchanger apparatus from the enclosed conduit space through the air outlet opening, wherein the partition fluidically isolates the first and second ambient airstreams from one another commencing at the partition bottom end, continues to fluidically isolate respective ones of the first and second ambient airstreams as the respective ones of the first and second ambient airstreams transform into respective ones of the hot humid airstream and the hot dry airstream and terminates fluidic isolation of the hot humid airstream and the hot dry airstream as the hot humid airstream and the hot dry airstream flow past the partition top end.

25. A method according to claim 24, further comprising the step of:

draining the remaining portion of the hot fluid to be cooled into the heat exchanger apparatus after the remaining portion of the hot fluid to be cooled is conveyed through the indirect heat exchanger device.

26. A hybrid heat exchanger apparatus adapted for cooling a hot fluid from a hot fluid source and having a cabinet portion, at least one air inlet at a bottom portion thereof and an air outlet at a top portion thereof, the cabinet portion forming an air-tight conduit disposed and extending between the at least one air inlet and the air outlet and defining an enclosed conduit space, the hybrid heat exchanger apparatus comprising:

a cooling fluid distribution system disposed in the enclosed conduit space and including a fluid distribution manifold having a first fluid distribution manifold section and a second fluid distribution manifold section with the first and second distribution manifold sections being in selective fluid communication with each other, each one of the first and second distribution manifold sections including a plurality of spray nozzles oriented relative to each other to define a common horizontal plane;

an indirect heat exchanger device and a direct heat exchanger device being horizontally juxtaposed to one another, the indirect heat exchanger positioned adjacent to and below the first fluid distribution manifold section and the direct heat exchanger positioned adjacent to and below the second fluid distribution manifold with the fluid distribution manifold, the indirect heat exchanger device and the direct heat exchanger device disposed above the at least one air inlet and below the air outlet as viewed in cross-section, both the indirect heat exchanger device and the direct heat exchanger device being disposed in the enclosed conduit space;

an air flow mechanism for causing air to flow upwardly from the at least one air inlet, through the cabinet portion across both the indirect heat exchanger and the direct heat exchanger and then across both the first and second fluid distribution manifold sections and thereafter from the enclosed conduit space through the air outlet; and a partition extending vertically and disposed between the indirect heat exchanger device and the direct heat exchanger device to terminate at a partition top end at or above the common horizontal plane and to terminate at an opposing partition bottom end at or below respective bottom portions of the indirect and direct heat exchanger devices, wherein the hybrid heat exchanger apparatus operates in either a wet mode or a hybrid wet/dry mode such that, ambient air flows upwardly from the at least one air inlet and into a first ambient airstream flowing across the direct heat exchanger device to generate a hot humid airstream and into a second ambient airstream flowing across the indirect heat exchanger device to generate a hot dry airstream, and, in the wet mode, the fluid to be cooled is distributed from the first and second distribution manifold sections onto corresponding ones of the indirect heat exchanger and the direct heat exchanger and, in the hybrid wet/dry mode, the fluid to be cooled is distributed from one of the first distribution manifold section onto the indirect heat exchanger and the second distribution manifold section onto the direct heat exchanger in order to generate the hot dry airstream and the hot humid airstream in a manner such that the hot humid airstream and the hot dry airstream flow upwardly and parallel to each other as the hot humid airstream and the hot dry air airstream flow upwardly across respective ones of the direct heat exchanger device and the indirect heat exchanger device, wherein the partition fluidically isolates the first and second ambient airstreams from one another commencing at the partition bottom end, continues to fluidically isolate respective ones of the first and second ambient airstreams as the respective ones of the first and second ambient airstreams transform into respective ones of the hot humid airstream and the hot dry airstream and terminates fluidic isolation of the hot humid airstream and the hot dry airstream as the hot humid airstream and the hot dry airstream flow past the partition top end.

27. A hybrid heat exchanger apparatus according to claim 26, wherein, in the hybrid wet/dry mode, the fluid to be cooled is distributed from the second distribution manifold section onto the direct heat exchanger.

28. A hybrid heat exchanger apparatus according to claim 26, wherein, in the hybrid wet/dry mode, the fluid to be cooled flows from the hot fluid source and through the indirect heat exchanger.

29. A hybrid heat exchanger apparatus according to claim 26, wherein, in the hybrid wet/dry mode, the fluid to be cooled flows from the hot fluid source and through the indirect heat exchanger and thereafter flows into the second distribution manifold section for distribution of the fluid to be cooled onto the direct heat exchanger.

30. A hybrid heat exchanger apparatus according to claim 26, wherein the cooling fluid distribution system includes a pump operative to pump the hot fluid to be cooled from the hot fluid source to fluid distribution manifold.

31. A hybrid heat exchanger apparatus according to claim 30, wherein the plurality of spray nozzles are connected to and in fluid communication with the fluid distribution manifold and wherein, in the hybrid wet/dry mode, the pump is operative to pump the hot fluid to be cooled though the indirect heat exchanger device and subsequently through the plurality of spray nozzles associated with the second fluid distribution manifold section.

32. A hybrid heat exchanger apparatus according to claim 30, wherein the pump is operative to pressurize the hot fluid to be cooled from the hot fluid source so that the hot fluid to be cooled from the hot fluid source is conveyed under pressure to the fluid distribution manifold.

33. A hybrid heat exchanger apparatus according to claim 26, further comprising a mixing baffle structure extending horizontally and positioned above the first fluid distribution manifold section and the second fluid distribution manifold section, the mixing baffle structure operative for mixing the hot humid air and the hot dry air together to form a hot air mixture thereof.

34. A heat exchanger apparatus according to claim 26, wherein the an air flow mechanism includes a first air flow mechanism and a second air flow mechanism, the first air flow mechanism being associated with first distribution manifold section and the indirect heat exchanger and the second air flow mechanism being associated with the second distribution manifold section and the direct heat exchanger.

35. A hybrid heat exchanger apparatus according to claim 26, wherein the indirect heat exchanger device includes a serpentine tube having a plurality of straight sections and a plurality of return-bend sections, respective ones of the plurality of return-bend sections interconnecting respective ones of the plurality of straight sections, each one of the plurality of straight sections extending generally along a horizontal direction within the enclosed conduit space.

36. A hybrid heat exchanger apparatus according to claim 35, wherein at least one of the plurality of straight sections includes at least one heat-exchange fin connected in thermal communication with the at least one of the plurality of straight sections, the at least one heat-exchange fin being oriented perpendicularly relative to the horizontal direction.

37. A hybrid heat exchanger apparatus according to claim 35, wherein at least one of the plurality of straight sections includes at least one heat-exchange fin connected in thermal communication with the at least one of the plurality of straight sections, the at least one heat-exchange fin being oriented perpendicularly relative to the horizontal direction.

* * * * *